US007784661B2

(12) United States Patent
Yagi

(10) Patent No.: US 7,784,661 B2
(45) Date of Patent: Aug. 31, 2010

(54) ELECTRIC STAPLER

(75) Inventor: Nobuaki Yagi, Tokyo (JP)

(73) Assignee: MAX Co., Ltd., Tokyo (JP)

( * ) Notice: Subject to any disclaimer, the term of this patent is extended or adjusted under 35 U.S.C. 154(b) by 234 days.

(21) Appl. No.: 12/089,168

(22) PCT Filed: Oct. 3, 2006

(86) PCT No.: PCT/JP2006/319791

§ 371 (c)(1),
(2), (4) Date: Apr. 3, 2008

(87) PCT Pub. No.: WO2007/040226

PCT Pub. Date: Apr. 12, 2007

(65) Prior Publication Data

US 2009/0230165 A1 Sep. 17, 2009

(30) Foreign Application Priority Data

Oct. 4, 2005 (JP) ..... 2005-291481
Oct. 4, 2005 (JP) ..... 2005-291483
Oct. 20, 2005 (JP) ..... 2005-306436
Oct. 21, 2005 (JP) ..... 2005-307283

(51) Int. Cl.
*B27F 7/21* (2006.01)

(52) U.S. Cl. ..... 227/131; 227/8; 227/129; 227/82; 227/119; 227/120; 227/138; 227/139

(58) Field of Classification Search ..... 227/131, 227/8, 129, 82, 119, 120, 138, 139
See application file for complete search history.

(56) References Cited

U.S. PATENT DOCUMENTS 4,588,121 A * 5/1986 Olesen ..... 227/120
4,623,082 A * 11/1986 Kurosawa ..... 227/7
5,150,826 A * 9/1992 Logtens ..... 227/88
5,346,114 A * 9/1994 Udagawa et al. ..... 227/120
6,050,471 A 4/2000 Yagi
6,164,513 A * 12/2000 Yoshie ..... 227/155
6,321,935 B1 * 11/2001 Yoshie ..... 221/197
6,474,633 B1 * 11/2002 Hirai ..... 270/58.09
6,568,579 B2 * 5/2003 Mochizuki ..... 227/131
6,634,536 B2 * 10/2003 Yoshie ..... 227/131
6,715,654 B2 * 4/2004 Sugihara et al. ..... 227/2
6,736,304 B2 * 5/2004 Mochizuki ..... 227/131
6,892,919 B2 * 5/2005 Higuchi et al. ..... 227/2

(Continued)

FOREIGN PATENT DOCUMENTS

JP 2002-46083 2/2002

(Continued)

*Primary Examiner*—Brian D Nash
(74) *Attorney, Agent, or Firm*—Drinker Biddle & Reath LLP

(57) ABSTRACT

An electric stapler includes a stapler main body and a driver assembly which is attachable and detachable with respect to the stapler main body. The driver assembly includes a forming portion having a forming plate for forming a staple into a U shape, a driver portion having a driver plate for striking the U-shaped staple into papers, a slide block portion which slidably guides the driver portion, and a slide guide case portion. The slide block portion, the driver portion and the forming portion are integrally incorporated in the slide guide case portion.

11 Claims, 24 Drawing Sheets

U.S. PATENT DOCUMENTS

| | | | | |
|---|---|---|---|---|
| 6,896,167 | B2 * | 5/2005 | Haramiishi | 227/131 |
| 6,974,068 | B2 * | 12/2005 | Mochizuki et al. | 227/131 |
| 7,014,091 | B2 * | 3/2006 | Mochizuki | 227/155 |
| 2004/0211811 | A1 * | 10/2004 | Hakozaki et al. | 227/131 |
| 2005/0284911 | A1 * | 12/2005 | Yagi et al. | 227/131 |
| 2006/0144890 | A1 * | 7/2006 | Haramiishi et al. | 227/120 |
| 2006/0157530 | A1 * | 7/2006 | Yagi | 227/155 |
| 2006/0289599 | A1 * | 12/2006 | Yagi | 227/154 |

FOREIGN PATENT DOCUMENTS

| | | |
|---|---|---|
| JP | 3518217 | 2/2004 |
| JP | 3533907 | 3/2004 |
| JP | 3533915 | 3/2004 |
| JP | 2005-22079 | 1/2005 |
| JP | 2005-351151 | 2/2005 |

* cited by examiner

ELECTRIC STAPLER

TECHNICAL FIELD

The invention relates to an electric stapler.

BACKGROUND ART

JP2005-022079A discloses an electric stapler in which a forming portion having a forming plate, a driver portion having a driver plate, an anvil, a crown plate and the like are disposed so as to be opposed to a clincher portion having a movable clincher with a paper table between them. In this electric stapler, the forming portion and the driver portion are moved to the clincher portion side, a staple is bent into a U shape with the forming plate and is struck out by the driver plate to cause the leg portions of the staple to penetrate through papers on the paper table, and this leg portions are bent with the movable clincher, thereby binding the papers.

In the electric stapler, the driver portion having the driver plate, the forming portion having the forming plate, the anvil, the crown plate and the like are configured to be separate from each other. Therefore, when dealing with a staple jam in the driver portion, when replacing the parts, or upon maintenance of the parts, there has been a problem that it takes time and labor to detach and to attach the driver portion and others.

That is, when there is something wrong with mechanism portions involved with a staple striking operation, e.g., the driver plate, the forming plate, the anvil or the like, various parts of the mechanism portions need be detached separately. Thus, there has been a problem that it is difficult as well as takes time and labor to address the staple jam, or to replace and maintenance the parts. Also, when it is necessary to change a crown width of a staple in accordance with the number of sheets of papers to be bound, a replacing work of the parts is troublesome. Further, because the individual parts are taken apart into pieces, it is onerous to manage and keep the parts.

If the driver portion and forming portion are structured as an integral body in order to enhance the maintenance thereof and to easily change the crown width in accordance with the number of sheets of papers to be bound, it is necessary to form a staple passage in the structure. However, when a trouble such as a staple jam occurs inside the staple passage portion, it takes much time and labor for repairing.

Further, if it is necessary to shift the positions of the driver portion, the forming portion or the like in the vertical and/or horizontal directions to detach them, it is difficult to understand the procedure of such detaching operation. Also it is necessary to provide a play in a main body side casing which supports a stapler mechanism.

In addition, since the forming portion, the driver portion and the like need be operated at their respective independent timings, a plurality of drive means, i.e., a plurality of drive parts such as drive cams or drive links, becomes necessary. In such a case, there is a disadvantage in terms of a machine size, the number of parts and the manufacturing cost of the electric stapler. JP2002-46083A and JP2005-35151A disclose an electric stapler operable to carry out a large amount of binding processing by employing a staple magazine inside which staple sheets, each having parallel adhered linear metal lines, are superimposed on top of each other and accommodated. This electric stapler is widely used as a stand-alone-type electric stapler or such that it is incorporated in a copying machine or the like.

The lower-most-layer one of the staple sheets superimposed inside the staple magazine is sent forward by a feed pawl provided in the stapler feed mechanism of the electric stapler, and a front linear staple is bent formed substantially into a U shape by the forming portion. The formed staple is introduced into a staple ejecting passage at the leading end of a staple feed passage. The staple inside the staple ejecting passage is struck out therefrom by a driver, and the leg portion of a staple having penetrated through papers is bent by a clincher provided on the side of the lower surface of the papers, whereby the papers are bound.

In a stapler, the precision of the staple ejecting passage has an influence on the binding performance and the rate of occurrence of the staple jam. When, the front-and-back direction width of the staple ejecting passage has no room with respect to the line diameter of a staple, the friction resistance when jetting out the staple is large, resulting in the lowered binding performance. On the other hand, when the room is excessively large, the attitude of the staple is disturbed when it is jetted out, whereby the staple is deformed within the jet passage and thus the staple jam is easy to occur. This requires high precision in the relative position relationship between the staple exit of the stapler main body on the staple magazine side and the staple ejecting mechanism including the forming portion, anvil, driver and the like. However, variations are easy to occur due to the forming allowance and assembling error between the mutually related parts thereof, and also, when breaking into parts or replacing the staple ejecting mechanism portion for maintenance, there is a fear that the relative position precision can be impaired.

DISCLOSURE OF THE INVENTION

One or more embodiments of the present invention provide an electric stapler in which a driver portion and its peripheral portion are unitized such that the unit is integrally attachable and detachable, whereby the driver portion can be attached and detached easily while facilitating the management and keeping of the parts when dealing with a staple jam in the driver portion, replacing parts, maintaining the parts, or changing a crown width.

One or more embodiments of the present invention provide an electric stapler in which the number of drive members thereof such as a drive cam and a drive link are reduced to be advantageous in terms of a stapler size, the number of parts and the manufacturing cost thereof, and further, to enhance the relative position precision of the drive members with respect to the stapler main body side staple passage.

Further, one or more embodiments of the present invention provide an electric stapler in which assembling precision of the staple ejecting mechanism portion is improved and stability of binding performance thereof is enhanced.

According to one or more embodiments of the present invention, an electric stapler includes a stapler main body and a driver assembly which is attachable and detachable with respect to the stapler main body. The driver assembly includes a forming portion having a forming plate for forming a staple into a U shape, a driver portion having a driver plate for striking the U-shaped staple into papers, a slide block portion which slidably guides the driver portion, and a slide guide case portion. The slide block portion, the driver portion and the forming portion are integrally incorporated in the slide guide case portion.

According to this configuration, structural parts necessary for the forming and striking of the staple, that is, the forming portion, the driver portion and the slide block portion are integrally accommodated into the slide guide case portion to thereby provide a driver assembly. This driver assembly is detachably attached into an opening formed in the front surface of the stapler main body. Therefore, for example, when carrying out an operation to replace the composing parts of the driver assembly and operation to maintain them, or an operation to change the crown width of the staple, the drive assembly may only be detached from the staple main body.

According to one or more embodiments of the present invention, the driver assembly further includes a fitting pin extending in a front-and-back direction of the stapler main body, and the stapler main body includes an openable and closable hold cover. The driver assembly is detachably attached to the stapler main body via the fitting pin, and the hold cover locks an upper portion of the driver assembly.

According to this configuration, the upper portion of the driver assembly is locked by the hold cover and the driver assembly is fixed to and mounted on the stapler main body in an engaged manner using a pin which extends in the front-and-back direction. To detach the driver assembly, the hold cover may be opened and the driver assembly may be pulled in the direction of the pin. In this manner, the driver assembly can be detached as it is from the stapler main body. On the other hand, to attach the driver assembly, the driver assembly may be pushed in the pin direction and then the hold cover may be closed.

According to one or more embodiments of the present invention, the electric stapler further includes an anvil serving as a bending base when forming the staple into the U shape, and a crown plate which supports a crown portion of the U-shaped staple. The anvil and crown plate are disposed on the slide block portion so as to be openable and closable respectively.

According to this configuration, when forming the staple, the anvil is opened outwardly of the slide block portion, the staple is put onto the anvil, and the forming portion is lowered to thereby form the staple into the U shape. The U-shaped staple is cut as the driver portion is moved down, and is put onto the crown plate. As the driver portion moves down further, the staple is struck into papers. In this case, with the downward movement of the driver portion, the crown plate is also retreated to the slide block portion side, thereby binding the papers.

According to one or more embodiments of the present invention, the electric stapler further includes a slide block latch oscillatably disposed on the slide block portion. The driver portion has a slot extending in a striking direction of the staple, and the slide block latch engages with the slot when the driver portion slides.

According to this configuration, the slide block portion includes a slide block latch which can be fitted into the slot of the driver portion such that it can be moved in the vertical direction. According to the driving timing of the driver portion, the slide block latch is engaged with the end portion of the slot, whereby, in linking with the driving of the driver portion, the slide block portion is driven by a given stroke. For example, when striking the staple, the projection of the end portion of the slide block latch is engaged with the upper end portion of the slot so that the slide block portion is driven and moved down in linking with the downward movement of the driver portion.

According to one or more embodiments of the present invention, the electric stapler further includes biasing means for downwardly biasing the slide block. The slide guide case portion has a support surface, and the slide block portion is slidably disposed with respect to the slide guide case portion. A portion of the slide block latch is pressed against the support surface of the slide guide case portion when the biasing means biases the slide block portion while the slide block portion is situated at a top dead center thereof.

According to this configuration, in the slide case portion in which the slide block portion is movably mounted and accommodated, there is disposed biasing means such as a spring or a press-down member which is used to resiliently bias the slide block portion downwardly. Accordingly, when the slide block portion is situated at the top dead center thereof, a portion of the slide block clutch, for example, a T-shaped bar is engaged with the support surface on the slide guide case portion side and is thereby pressed against it. Therefore, in the wait time, there is no fear that the slide block portion can produce rickety motion or play.

According to one or more embodiments of the present invention, the driver assembly includes a lock mechanism which, when detaching the driver assembly from the stapler main body, locks the forming portion, the driver portion and the slide block portion at respective regular home positions with respect to the slide guide case portion.

According to this configuration, interior movable parts such as the driver portion and forming portion are movably incorporated in the slide guide case portion. When detaching the driver assembly at its home position from the stapler main body, for example, when releasing the fixation and holding of the driver assembly (e.g., a hold cover 38 of an embodiment) with respect to the stapler main body, the lock mechanism is operated in linking with this releasing operation to thereby lock and fix the interior movable parts such as the driver portion at their respective home positions.

According to one or more embodiments of the present invention, the driver assembly or the stapler main body further includes an unlock mechanism which, when attaching the driver assembly to the stapler main body, releases a locked state of the lock mechanism.

According to this configuration, when the driver assembly is attached to the stapler main body, the unlock mechanism such as a cam is operated to unlock the lock mechanism, thereby releasing the locked state of the interior movable parts with respect to the slide guide case portion.

According to one or more embodiments of the present invention, the forming portion, the driver portion and the slide block portion are formed with engaging grooves on one side portion thereof respectively. The lock mechanism includes a lock pin which is engageable and disengageable with respect to the engaging grooves. When the lock pin is engaged with the engaging grooves, the forming portion, the driver portion and the slide block portion are locked at the respective regular home positions with respect to the slide guide case portion.

According to this configuration, in the respective one side portions of the interior movable parts such as the driver portion, there are formed the engaging grooves with which the lock pin can be disengagably engaged. Since, when the driver assembly is engaged with or disengaged from the stapler main body, the lock pin is driven and engaged with the engaging grooves, the interior movable parts can be locked at their respective home positions.

According to one or more embodiments of the present invention, each the engaging grooves if formed such that a groove depth thereof is increased in accordance with a dimension of a width of each of the forming portion, the driver portion and the slide block portion.

According to this configuration, the depth dimensions of the engaging grooves of the forming portion, the driver portion and the slide block portion increase as the width dimensions thereof increase. Therefore, unless all or some of the interior movable parts have been returned to their regular home positions, the interior movable parts can be manually returned step by step to their regular home positions for locking.

For example, when the width dimension of the forming portion is larger than that of the driver portion and the width dimension of the driver portion is larger than that of the forming portion, according to the order of the sizes of the depth dimensions of the engaging grooves, that is, in order of the slide block portion, driver portion and forming portion, these respective portions are returned step by step to their regular home positions for locking.

According to one or more embodiment of the present invention, the stapler main body includes a driver drive device, a staple feed assembly, a frame inside which the driver drive device and the staple feed assembly are accommodated, and an elastic member. The staple feed assembly includes a staple storage portion disposed so as to be back-and-forth movable with respect to the frame, and the elastic member forwardly biases the staple storage portion to cause the staple storage portion to be in pressure contact with the driver assembly which is attached on a front surface of the frame.

According to one or more embodiments of the present invention, the stapler main body includes a driver drive device, a staple feed assembly, and a frame inside which the driver drive device and the staple feed assembly are accommodated. The staple feed assembly comprises a staple storage portion disposed so as to be slightly movable in an up-and-down direction and in a right-and-left direction with respect to the frame. A pin is provided on one of mutually opposing surfaces of the driver assembly and staple storage portion while a positioning hole is provided on the other surface, and the pin is fitted into the positioning hole.

According to one or more embodiments of the present invention, since a forming portion, a driver portion and a slide block portion are unified together into a driver assembly as a unit such that the driver assembly can be attached and detached with respect to the stapler main body, there can be provided an effect that the replacement, cleaning and inspection of the parts such as the forming plate and driver plate, or the removing processing of the staple jam, or the change of the crown width of the staple can be carried out easily and quickly only by taking out the driver assembly from the stapler main body. Also, since the parts such as the forming plate and driver plate are taken out as an integral body, the management and keeping of the parts can be facilitated.

According to one or more embodiments of the present invention, when attaching or detaching the driver assembly, the hold cover may be opened and the driver assembly may be moved linearly in the direction of the pin. This makes it possible to attach or detach the driver assembly easily and quickly. That is, since the driver assembly can be attached and detached without shifting it in the vertical direction and in the right and left direction, not only the procedure for the driver assembly attaching and detaching operation is very easy to understand but also there is eliminated the need to provide an escape space in the main body side casing.

According to one or more embodiments of the present invention, since an anvil and a crown plate are provided in the slide block portion such that they can be opened and closed, there can be provided an effect that, simply by detaching the driver assembly, the anvil and crown plate can be replaced and maintained easily and, especially, when changing the crown width of the staple, the replacement and maintenance of the anvil and crown plate can carried out further easily. Also, since there is formed a staple passage which can be opened and closed, there can be obtained an advantage that the staple forming and striking operations can be executed continuously with high efficiency.

According to one or more embodiments of the present invention, when a slide block latch is engaged with the end portion of a slot according to the driving timing of the driver portion, the slide block portion is driven in linking with the driving of the driver portion. Therefore, both the driver plate of the driver portion and slide block portion can be driven by a single drive source, which eliminates the provision of drive means exclusively used to drive the slide block portion. That is, the provision of the slide block latch capable of connecting and detaching the slide block portion and driver portion at a given operation timing can reduce the number of drive members such as a drive cam and a drive link, thereby providing the excellent effect that the size of the electric stapler, the number of parts, the space for provision of parts and the cost of the electric stapler can be reduced.

According to one or more embodiments of the present invention, since there is provided biasing means which, when a slide block portion with an anvil or the like mounted thereon is situated at the top dead center thereof, biases and presses a portion of the slide block latch against the support and fix surface of the slide guide case portion, it is possible to prevent the slide block portion from generating rickety motion or play, thereby being able to stably secure a required relative position precision between the anvil of the slide block portion and the staple passage of the stapler main body.

That is, since, in order to be able to fix the slide block portion at the top dead center (home position), a portion of the lower surface of the slide block latch is pressed by the biasing force of the biasing means so as to be contacted with the upper portion of the fix surface, the rickety motion of the slide block portion can be prevented and thus the high-precision positioning and holding can be attained positively.

According to one or more embodiments of the present invention, when the driver assembly is detached from the stapler main body, the interior movable parts such as the driver portion is locked at their respective home positions by the lock mechanism, whereby, when attaching and detaching the driver assembly, the position shift of the interior movable parts can be prevented positively. This can facilitate the attaching and detaching of the driver assembly and also can eliminate the need to manually return the interior movable parts to their home position each time the driver assembly is attached or detached.

According to one or more embodiments of the present invention, when attaching or detaching the driver assembly, the locked states of the interior movable parts are released. This not only can save time and labor for an operator to manually release the locked states of the movable parts but also can prevent the occurrence of a wrong operation such as forgetting to release the locked state of the movable parts. Also, in the staple striking operation, the interior movable parts such as the driver portion are put into states where the biasing force of the spring is not applied thereto, and thus the movable parts are not slid under the biasing force. This can prevent the interior movable parts from being damaged due to wear or the like.

According to one or more embodiments of the present invention, since, when attaching and detaching the driver assembly, the lock pin is engaged with the engaging grooves of the interior movable parts, only a single lock pin may be used, thereby being able to employ a simple structure for the electric stapler. This can provide an effect that the operation to lock the interior movable parts can be carried out automatically and positively.

According to one or more embodiments of the present invention, even when the interior movable parts have not been returned to their regular home positions, they can be returned step by step to the regular home positions for locking. Therefore, in addition to the effects of the invention as set forth in claim 3, there is provided an effect that it is not necessary to return all of the interior movable parts to their home positions at the same time, thereby being able to carry out the lock operation easily and quickly.

According to one or more embodiments of the present invention, when the driver assembly is assembled to the front surface of the frame with the staple feed assembly incorporated therein, a staple storage portion, which is an integral body of a staple chamber and a guide portion for guiding a staple, is biased by an elastic member and is thereby resiliently contacted with the driver assembly. This can prevent the occurrence of play in the front-and-back direction between the driver assembly and the guide portion on the staple feed assembly, thereby being able to enhance the stability of the staple forming and ejecting operations.

Also, the pin is provided on one of the mutually facing surfaces of the driver assembly and staple storage portion while the positioning hole is formed on the other surface, and the pin is fitted into the positioning hole to determine the relative positions of the driver assembly and staple storage portion. Therefore, when assembling the driver assembly, the position of the driver assembly is automatically set correctly to thereby prevent the drive assembly from shifting in position not only in the vertical direction but also in the right and left direction, resulting in the enhanced stability of the staple forming and ejecting operations.

EXPLANATION OF REFERENCE NUMERALS AND SIGNS

Figure 1:
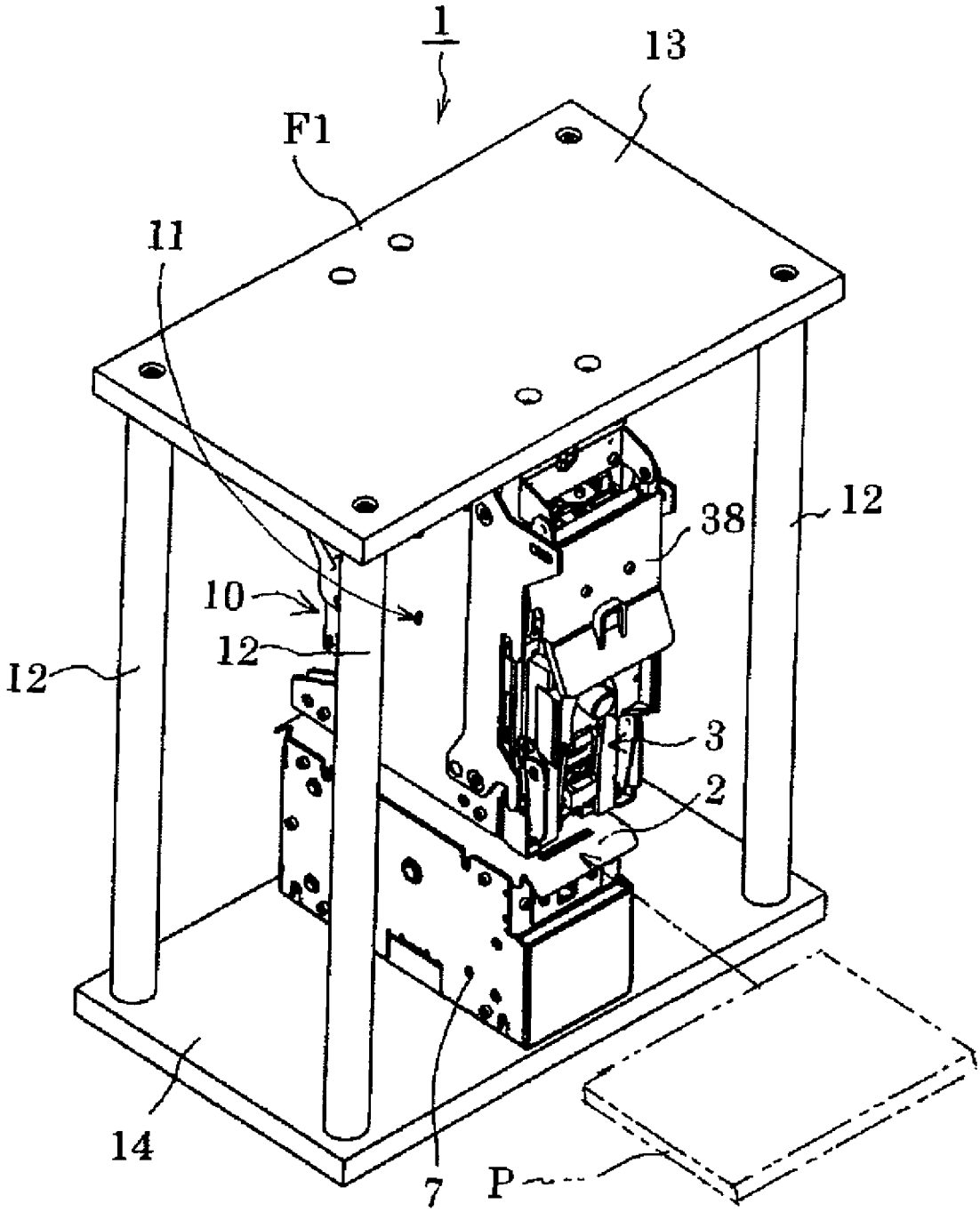
FIG. 1 is a perspective view of the whole structure of an electric stapler according to an embodiment of the invention.

1 Electric stapler
2 Paper table
3 Driver assembly
4 Forming portion
5 Driver portion
6 Slide block portion
7 Clincher portion
8 Forming plate
9 Driver plate
10 Staple feed assembly
11 Stapler main body
15 Anvil (Bending base)
16 Front slide guide case portion
17 Rear slide guide case portion
18 Driver holder
20 Staple sheet storage portion
21 Positioning pin (Fitting pin)
22 Pin hole
24 Compression coil spring (Elastic member)
28 Side panel
29, 30 Slot
31, 32 Pawl portion
33, 34 Cut-out recessed portion
35, 36 Projection
37 Positioning hole
38 Hold cover
46 Drive motor
48 Drive cam

49 Drive link for Driver
50 Drive link for Forming
54 Fitting pin
56 T-shaped hole
56*a* Support surface
59 Face back plate
63 Projecting portion
64 Lug
65 Lock lever
67 Slide block pusher (Biasing means)
68 Compression coil spring (Biasing means)
70 Latch slot
71, 72 Slot
74 Slide block latch
76 Lower end projecting portion
77 Upper end projecting portion
78, 79 T-shaped bar
80 Crown plate
82 Latch slot
84 Forming holder
85 Latch slot
86 Cut-out recessed portion
88 Penetration hole
89 Engaging groove
90 Engaging groove
91 Engaging groove
92 Stepped portion
93 Cam projection
94 Hold latch
95 Cam surface (Unlock mechanism)
96 Latch hold member
97 Rail portion
99 Lock pin (Lock mechanism)
101 Tension coil spring (Biasing means)
204 Driver drive device
211 Magazine storage portion
213 First staple feed mechanism
214 Second staple feed mechanism
220 Flange portion
226 Driver assembly lock mechanism
242 Slide block
P Papers
S Staple

BEST MODE FOR CARRYING OUT THE INVENTION

According to an embodiment of the invention, there is provided an electric stapler which includes a forming portion having a forming plate for forming a staple into a U shape, a driver portion having a driver plate for striking the U-shaped staple into papers, and a slide block portion for guiding the striking operation of the driver portion in a slidable manner. In this electric stapler, the slide block portion, driver portion and forming portion are integrally incorporated into a slide guide case portion to form a driver assembly, and the driver assembly is detachably attached onto a stapler main body.

For example, when one or more of the parts are damaged, simply by detaching and replacing the driver assembly as it is, the damaged part(s) can be recovered immediately. Also, when changing the crown width of the staple as well, simply by replacing the driver assembly, the crown width of the staple can be changed easily and quickly.

On the stapler main body, there is provided a hold cover which can be opened and closed and is used to lock the upper portion of the driver assembly, and the driver assembly is detachably attached on the stapler main body through a fitting pin which extends in the front-and-back direction of the stapler main body. According to this configuration, the attaching and detaching direction of the driver assembly provides a linear direction in the front surface of the stapler main body, which makes it possible to carry out the driver assembly attaching and detaching operation simply by inserting and pulling out the driver assembly and thus can prevent the attaching and detaching operation from being executed in the wrong way. Also, a dead space necessary for the operation can be minimized.

In the slide block portion, there are provided an anvil serving as a bending base used when forming a staple as well as a crown plate for supporting the crown portion of the U-shaped staple such that they can be opened and closed. The anvil and crown plate can be controlled, namely, can be opened and closed such that they can move forwardly or backwardly of the staple passage side at a given timing in linking with the operation of the driver portion. This enables the attaching and detaching of the driver assembly including the anvil and crown plate, so that the change of the crown width and the replacement of parts can be carried out further easily.

Also, in the driver assembly, there can be formed an openable and closable staple passage (in the illustrated embodiment, the openable and closable anvil 15, crown plate 80 and face back plate 59) in a simple structure. In this case, suppose the anvil and face back plate are provided such that they can be opened and closed, when there is generated a trouble such as a staple jam in the staple passage portion, an operation to recover such trouble can be carried out more quickly.

As described above, the means for attaching the driver assembly onto the stapler main body and detaching the former from the latter is structured such that the driver assembly is moved linearly on the front surface of the stapler main body. In this case, for example, as means for engaging or fitting the driver assembly with the stapler main body, there can be employed a positioning pin and a fitting hole. As means for attaching, detaching and holding the driver assembly, there can be employed a link lever which is easy to lock and to unlock. This can further enhance the efficiency of the linear attaching and detaching operation of the driver assembly, which can minimize the structural and design limit of a casing for supporting the electric stapler.

Also, according to an embodiment of the invention, the electric stapler includes a driver portion for striking a staple and a slide block portion for guiding the striking operation of the driver portion. In the driver portion, there is formed a slot which extends in the staple striking direction and, in the slide block portion, there is provided a slide block latch which can be oscillated in the vertical direction and also can be movably fitted into the slot. According to the driving timing of the driver portion, the slide block latch is engaged with the end portion of the slot, whereby the slide block portion can be driven in linking with the driving of the driver portion.

The slide block portion and driver portion, which are near to each other in the operation stroke, are driven by a single common drive link. In the slide block portion, there is properly formed a groove hole or the like which can be fitted with the slide block latch, thereby controlling the connection and separation between the slide block latch and driver holder. The movement of the slide block portion can be switched between a hold state, a driving state and a free movement state according to the movement of the driver plate. Thus, as the driver link, there may be used only two kinds of links, one for a driver plate and the other for a forming plate.

In this case, the operation range of the drive link may be set slightly above the top dead center and, between the drive link and slide block portion, there may be interposed a spring (resilient biasing means) which can be used to press the slide block portion against the fix surface of the slide guide case portion below the slide block portion. That is, there is provided a spring which, when the slide block portion with the anvil and the like mounted thereon is situated at the top dead center thereof, presses the slide block latch against the fix surface of the slide guide case portion.

Accordingly, when positioning the slide block portion at the top dead center, the removal of the rickety motion of the slide block portion and the positioning of the slide block portion are both possible. That is, in a structure where an anvil or the like is mounted on the slide block portion, the height position of the anvil in the home position wait time must coincide with the height position of the staple passage formed in the stapler main body. However, the drive link or the like requires a slight degree of rickety motion from the viewpoint of the operation thereof and thus there is generated some play at the top dead center. In view of this, by pressing a portion (e.g., T-shaped portion 78) of the slide block latch against the fix portion (e.g., the support surface 56*a* of the T-shaped hole 56) at the top dead center using the spring, the production of rickety motion in the slide block portion can be prevented to thereby enable the high-precision positioning of the slide block portion.

Further, according to an embodiment of the invention, a forming portion for forming a staple into a U shape, a driver portion for striking the U-shaped staple into papers and a slide block portion for guiding the operation of the driver portion in a slidable manner are incorporated into a slide guide case portion to thereby provide a driver assembly, and the driver assembly is detachably attached onto the a stapler main body. In the driver assembly, there is provided a lock mechanism which, when detaching the driver assembly, locks the forming portion, the driver portion and the slide block portion respectively at their regular home positions with respect to the slide guide case portion.

When the driver assembly is detached at the home position, the forming portion, the driver portion and the slide block portion are locked and fixed at their respective home positions by the lock mechanism. More specifically, in the one-side portions of the forming portion, the driver portion and the slide block portion, there are formed engaging grooves respectively, while the lock mechanism has a lock pin which can be disengagably engaged with these engaging grooves. This is lock pin is biased in the locking and engaging direction with respect to the engaging grooves by biasing means such as a magnet.

At the time when the driver assembly is attached or detached, in some cases, the interior movable parts have not returned to their regular home positions for some reasons. In such cases, the interior movable parts must be returned to their regular home positions where the lock pin can be engaged with the engaging grooves. In these cases, when the forming portion, the driver portion and the slide block portion are all the same in the width dimension and engaging grooves thereof, the lock pin cannot be operated unless these three portions are retuned at the same time and thus, when attaching the driver assembly, the driver assembly cannot be fixed to and held at the home position with respect to the stapler main body.

Thus, in order that the forming portion, the driver portion and the slide block portion can be returned individually to their respective regular positions and thus the driver assembly can be correctly fixed to and held by the stapler main body, the width dimensions of these three portions and the depths of the engaging grooves are formed such that they are shifted from each other.

For example, the width dimension of the slide block portion and the engaging groove depth thereof are set largest, while the width dimensions and engaging grooves depths of the driver portion and forming portions of the driver portion and forming portion are set reduced in this order. According to this configuration, even when the interior movable parts such as the driver portion have not returned to their regular home positions at the time of detaching the driver assembly, the slide block portion, driver portion and forming portion can be returned and locked to their home positions step by step in the order of the engaging groove depth size, that is, in this order. This can eliminate the need to return all of them to their respective home positions at the same time.

In the driver assembly or the stapler main body, there is provided an unlock mechanism such as a cam which can release the locked state of the lock mechanism. The unlock mechanism is structured such that, at the time when the driver assembly is attached to the stapler main body, it can unlock the locked state of the lock mechanism. For example, in a structure including a cover or the like which can hold and fix the driver assembly, the unlock mechanism may be structured such that it can carry out its unlocking operation when the driver assembly is held and fixed by the cover or the like.

According to this configuration, at the time when the driver assembly is held and fixed by the cover or the like (when the driver assembly is mounted), the unlock mechanism is operated and the locked state of the lock mechanism is automatically released, thereby eliminating the need for an operator to execute the unlocking operation by hand.

Alternatively, there may also be employed a structure that, by operating one of the slide block portion, driver portion and forming portion, these portions can be returned to their home positions at the same time. Also, means for biasing the lock mechanism is not limited to a spring but, as such biasing means, there can also be used a magnet. In order to be able to positively stop all of the three portions at their regular wait positions, there can also employed a structure in which the respective partial portions of these three portions are pressed by the forces of the biasing means against a member to be pressed, which is disposed, for example, on the slide guide case portion side, and are thereby positioned and fixed there.

Further, according an embodiment of the invention, there is provided an electric stapler in which a driver assembly including at least a driver portion and a forming portion is mounted on the front surface of a frame incorporating therein a driver drive device and a staple feed assembly. In this electric stapler, a staple storage portion, which includes a staple chamber or a staple magazine chamber integrally unified with a guide portion for guiding a staple to the driver assembly, is assembled to the frame such that it can be moved in the front-and-back direction as well as in the up-and-down direction and in the right-and-left direction. The staple storage portion is biased forward by an elastic member. A pin is provided on one of the mutually facing surfaces of the driver assembly and staple storage portion while a positioning hole is formed on the other surface, and the staple storage portion is pressure contacted with the driver assembly by the elastic member to thereby fit the pin into the positioning hole.

EMBODIMENT

Hereinafter, an embodiment of the present invention will be described with reference to FIGS. 1 to 22B. In an electric stapler 1 according to the embodiment of the invention, papers P are set on a paper table 2. A forming portion 4, a driver portion 5 and a slide block portion 6, which cooperate together in forming a driver assembly 3, are moved down to the lower side of a clincher portion 7. A staple S formed by the forming plate 8 of a forming portion 4 is struck out by the driver plate 9 of the driver portion 5 and is penetrated through the papers P, and then, the leg portions of the staple S are bent by a movable clincher (not shown) which is provided in the clincher portion 7.

In the embodiment of the invention, the slide block portion 6 and driver portion 5, which are close to each other in the operation stroke thereof, are driven by a single drive link. Such as slots 82, 85 are formed at portions of the slide block portion 6 so that the upper and lower end portions of a slide block latch 74 can be contacted with the front surfaces of the driver portions 5, 17 at given positions, and connection and separation between the slide block portion 6 and driver portion 5 through the slide block latch 74 are controlled at a given timing. Thus, the movement of the slide block portion 6 can be switched between the holding movement, driving movement and free movement thereof according to the movement of the driver portion 5. For example, when the driver portion 5 is moved down, the slide block portion 6 is switched in the order of the holding movement, lowering movement and free lowering movement. By the way, when the driver portion 5 is moved up, the slide block portion 6 is moved in the reversed order to the above order.

That is, the electric stapler 1 includes the forming portion 4 having a forming plate 8 for forming a staple, the driver portion 5 having a driver plate 9 for striking out the formed staple, the slide block portion 6 having a guide recessed portion 73 for guiding the driver portion, an anvil 15 serving as a bending base, a face back plate 59, and the like. Also, by providing a slide block latch 74 which is used to connect and separate the slide block portion and driver portion 5 at a given timing, the slide block portion 6 can be driven in linking with the driving of the driver portion 5, thereby eliminating the need for provision of an independent drive link or the like for the slide block portion.

Figure 6:
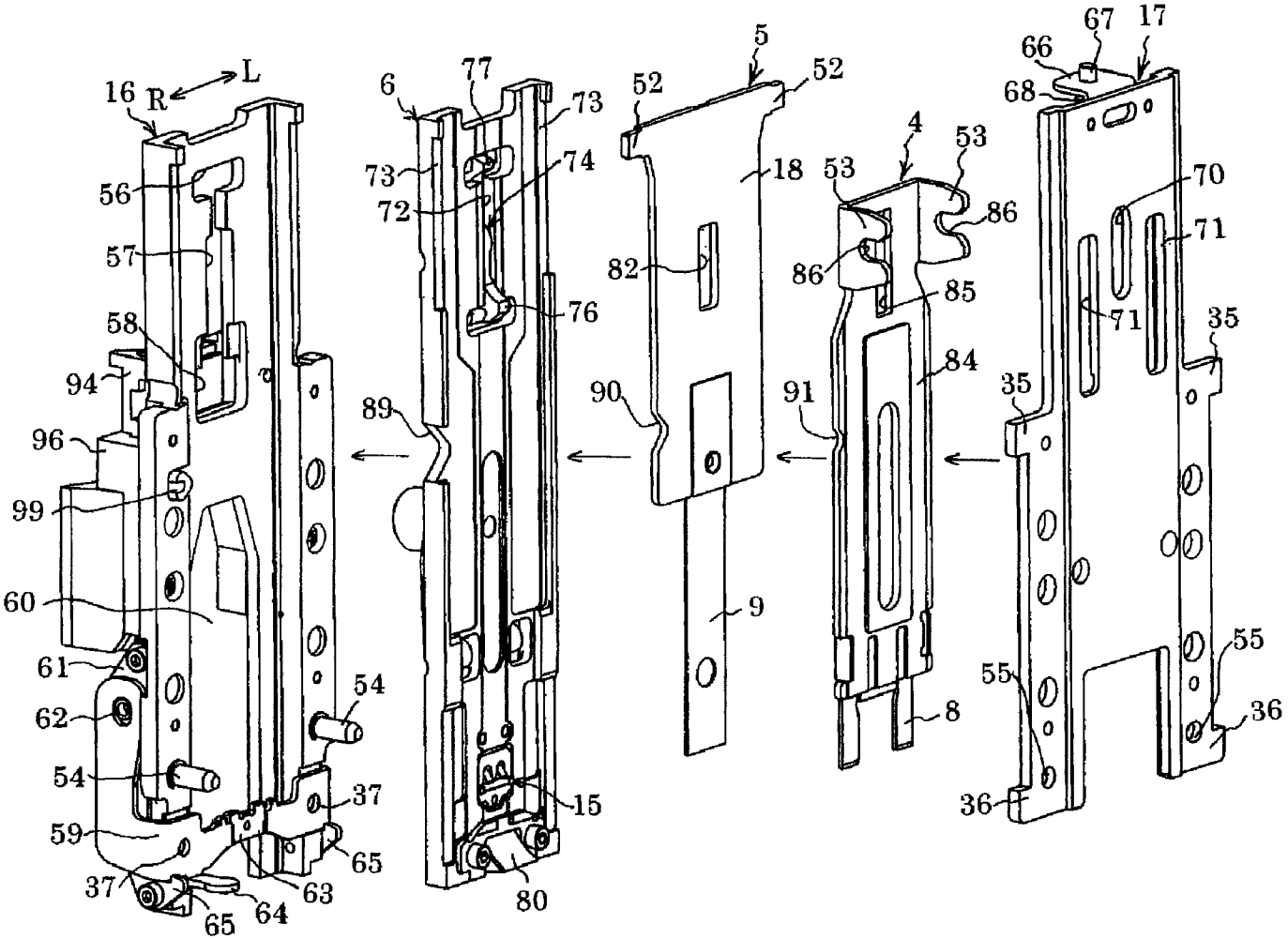
FIG. 6 is an exploded perspective view of the driver assembly.

As shown in FIG. 1, the electric stapler 1 is substantially includes a clincher portion 7 having a movable clincher, and a stapler main body 11 on which a driver assembly 3 and a staple feed assembly 10 are detachably attached. The clincher portion 7 is mounted on a lower plate 14, while the stapler main body 11 is mounted on an upper plate 13, and the clincher portion 7 and stapler main body 11 are opposed to each other in the vertical direction with paper table 2 between them. Here, the stapler main body 11 and clincher portion 7 are disposed spaced from each other in the vertical direction. Also, the upper and lower plates 13 and 14 are connected to each other by poles 12. The driver assembly 3 is structured such that, as shown in FIG. 6, a forming portion 4 for forming a staple S on an anvil (a bending base) 15 into a U shape, a driver portion 5 for striking the U-shaped staple into papers S and a slide block portion 6 for guiding the striking operation of the driver portion 5 in an slidable manner are formed into a unit, and this unit is integrally incorporated into slide guide case portions 16, 17 and is accommodated thereinside.

Figure 2:
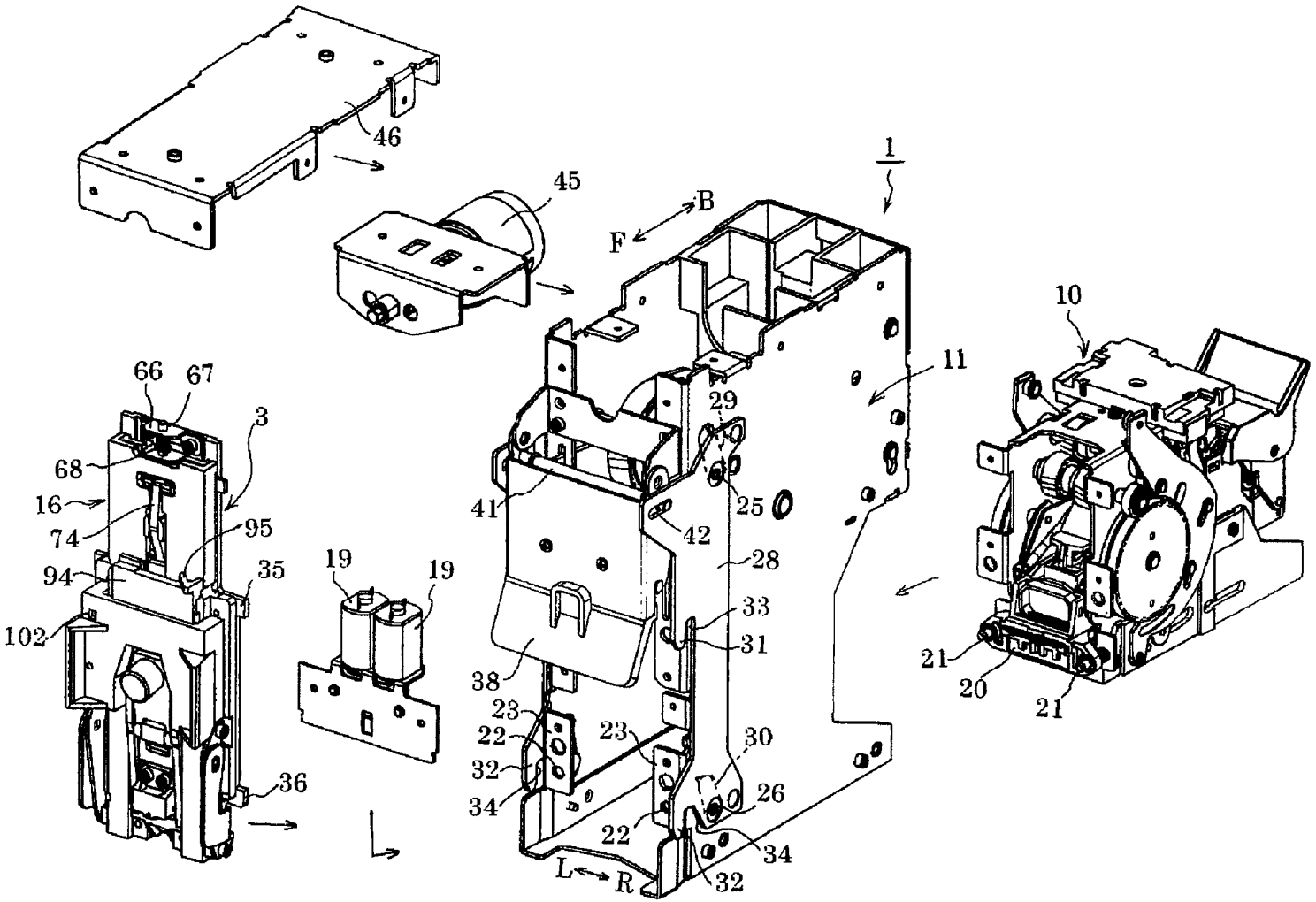
FIG. 2 is an exploded perspective view of the electric stapler shown in FIG. 1.

As shown in FIG. 2, the staple feed assembly 10 is driven by a staple feed motor 19 to feed out a staple sheet SS stored in a staple sheet storage portion 20 to the driver assembly 3 side at a given timing. On the lower portion of the front surface of the staple feed assembly 10, there are provided a pair of right and left positioning pins 21, while the positioning pins 21 and the like are resiliently biased toward the driver assembly 3 by a compression coil spring 24.

Figure 3A:
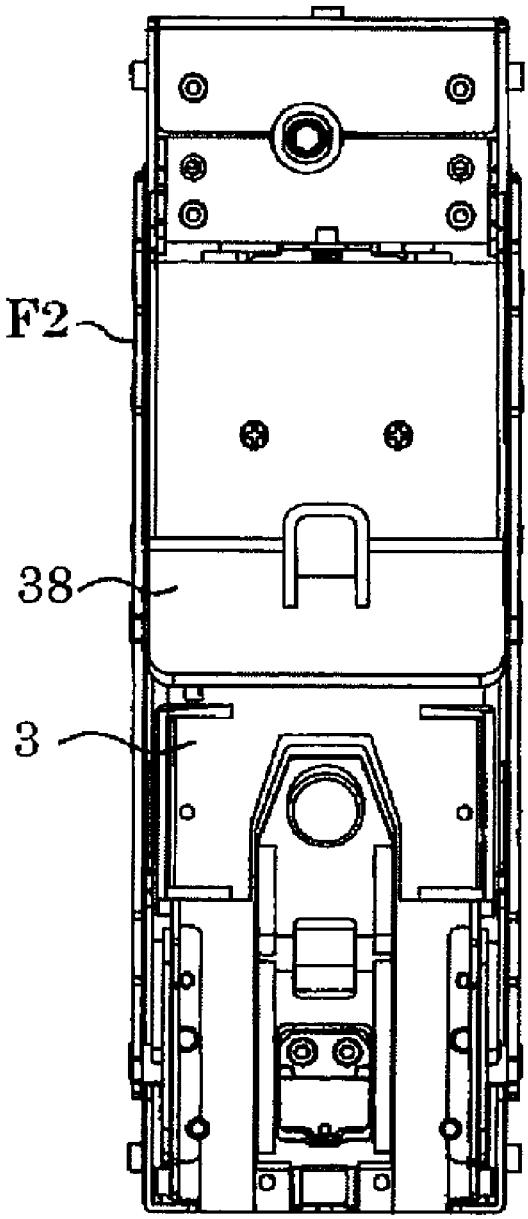
FIG. 3A is a front view of a stapler main body 11 of the electric stapler.
Figure 3B:
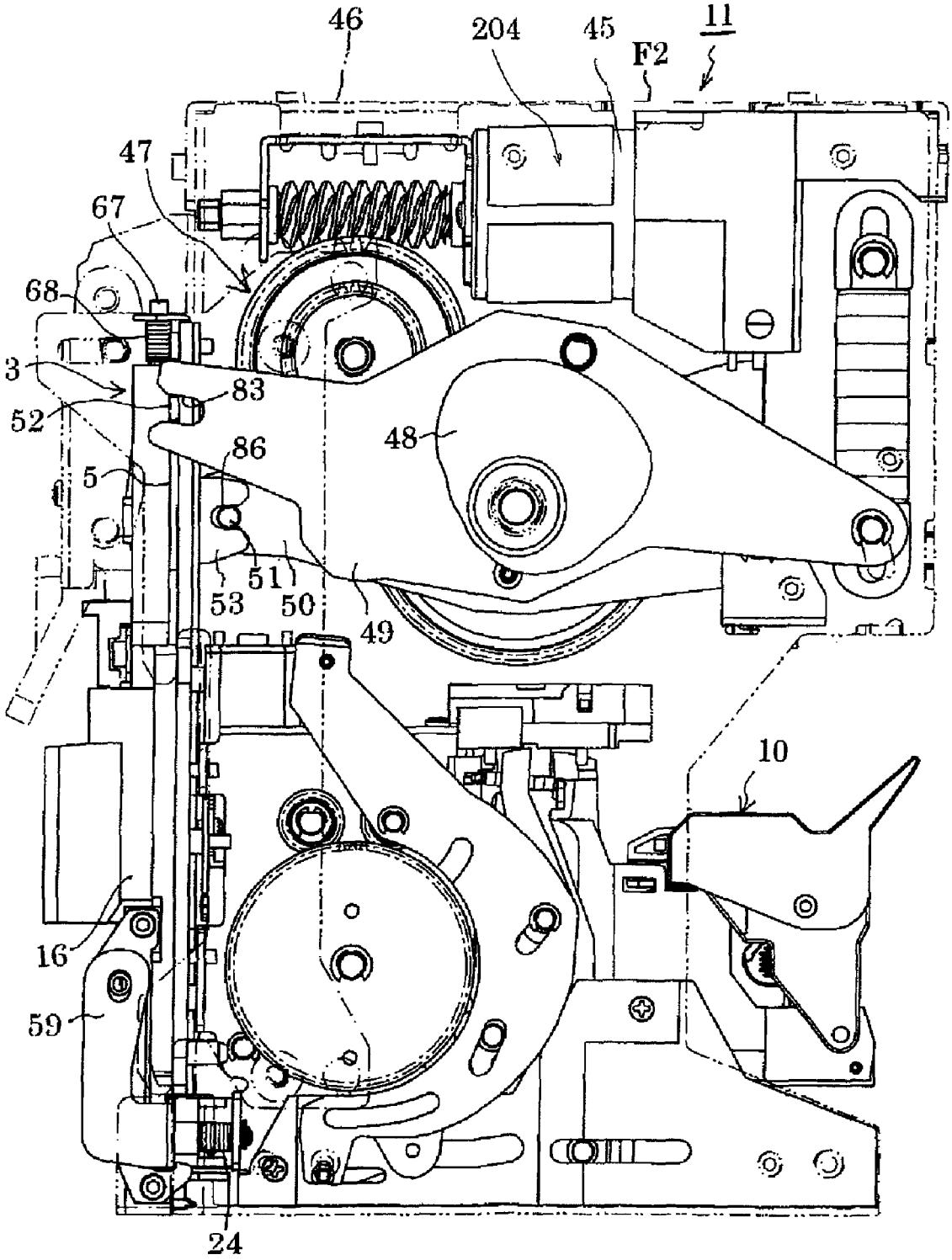
FIG. 3B is an internal side view of the stapler main body 11 of the electric stapler.
Figure 3C:
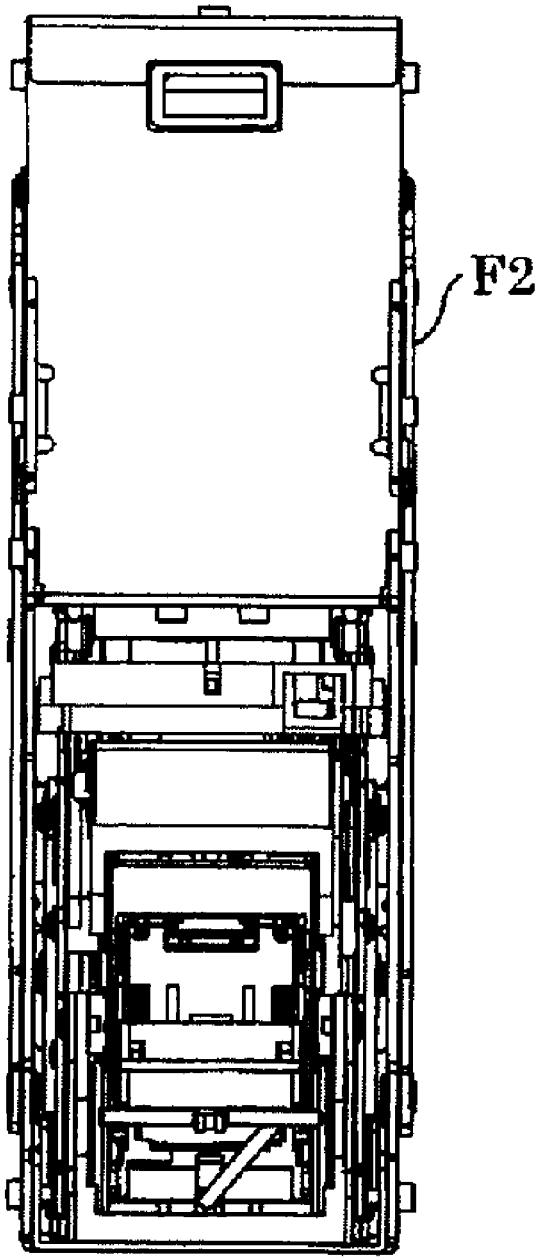
FIG. 3C is a back view of the stapler main body 11 of the electric stapler.

As shown in FIGS. 3A to 3C, the casing of the stapler main body 11 has a front surface opening, while the driver assembly 3 and staple feed assembly 10 are detachably attached into the stapler main body 11 respectively from the front surface side (forward F side) of the casing and from the back surface side (backward B side) thereof. Also, as shown in FIG. 2, to the two side edges of the lower portion of the front surface opening of the stapler main body 11, there are fixed two plates 23 which respectively have pin holes 22.

On both sides of the front portion of the stapler main body 11, there are provided two side panels 28 which respectively include pins 25, 26 respectively provided in the upper and lower portions thereof. The pins 25, 26 are slidably fitted into slots 29, 30 which are respectively obliquely formed in the upper and lower portions of the side surface of the stapler main body 11. Further, on the front side of the side panel 28, there are provided a pair of upper and lower pawl portions 31, 32. Into the cut-out recessed portions respectively formed inside the pawl portions 31, 32, there are disengagably engaged projections 35, 36 which are provided on the rear side slide guide case.

Figure 4:
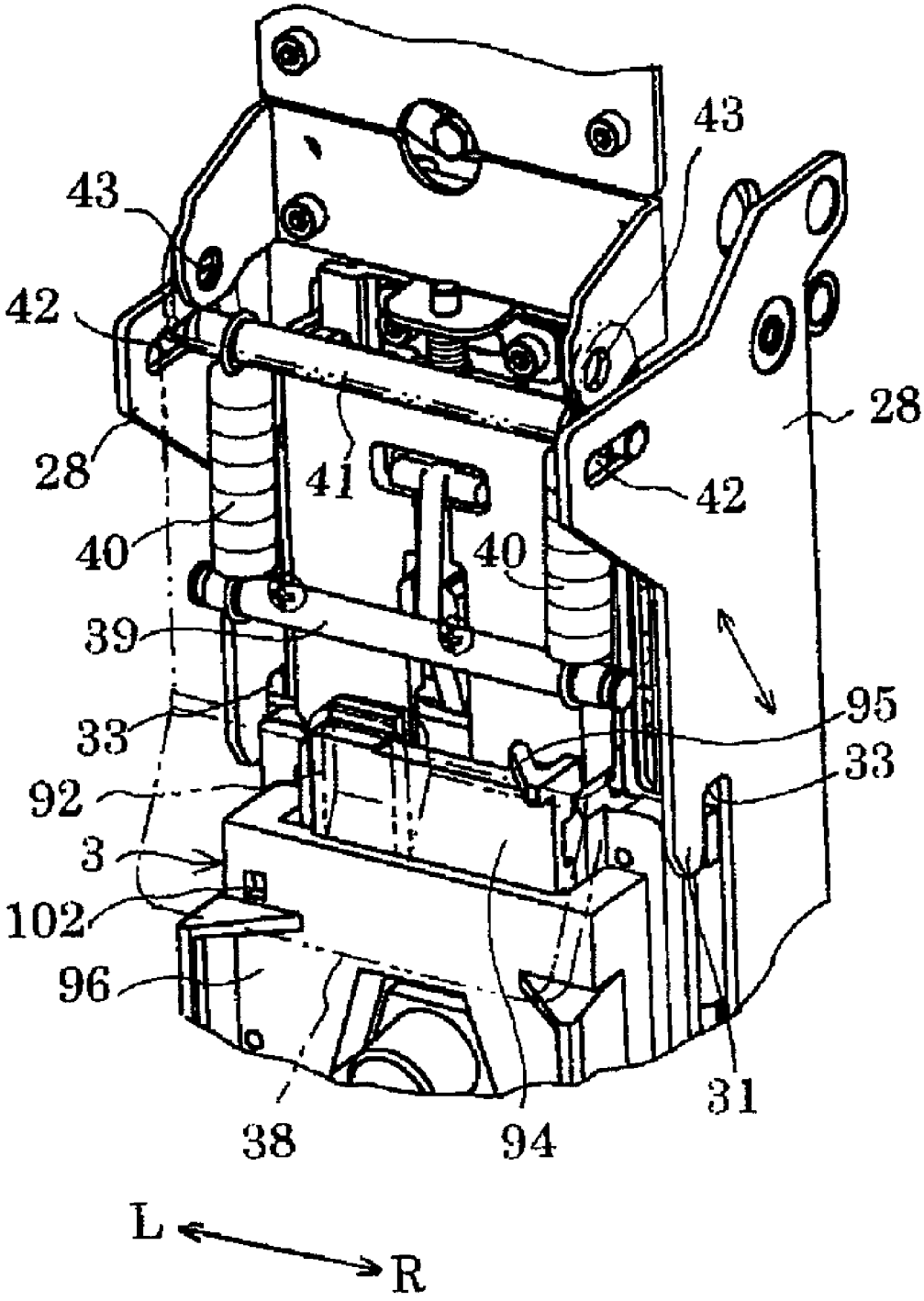
FIG. 4 is a perspective view of the main portions of a lock mechanism for locking a hold cover used in the electric stapler.

On the upper side of the front surface opening of the stapler main body 11, there is provided a lever-type hold cover 38 which is used to fix the upper portion of the driver assembly 3 such that the locked state thereof can be released, and the lower portion of the hold cover 38 is formed bent toward this side. To the back surface of the upper portion of the hold cover 38, there is connected a shaft 39 which extends horizontally and, as shown in FIG. 4, with the neighboring portions of the two ends of the shaft 39, there are engaged the lower end portions of a pair of right and left tension coil springs 40. The upper end portions of the tension coil springs 40 are engaged with the neighboring portions of the two ends of a shaft 41 which extends parallel to the shaft 39.

The two end portions of the upper shaft 41 are respectively slidably fitted into slots 42 which are respectively formed in the upper portions of two side panels 28. Therefore, when the hold cover 38 is lifted up, the hold cover 38 is rotated upwardly around a horizontal shaft 43 and the side panels 28 are moved obliquely upwardly along the slots 29, 30, thereby releasing the engaged and locked state between the cut-out recessed portions 33, 34 and assembly side projections 35, 36.

On the other hand, on the upper portion of the stapler main body 11, there is disposed a drive motor 45 and also there is mounted an upper cover 46. As shown in FIG. 3B, the output of the drive motor 45 is transmitted through a gear mechanism 47 to a drive cam 48, thereby driving and oscillating a drive link 49 in the vertical direction. With the oscillatory motion of the drive link 49, a projection 52 on the driver portion side is moved up and down at a given timing. Also, in linking with the driving of the drive motor 45, a drive link 50 is oscillated in the vertical direction and a projection on the forming portion side is moved up and down at a given timing.

Figure 5:
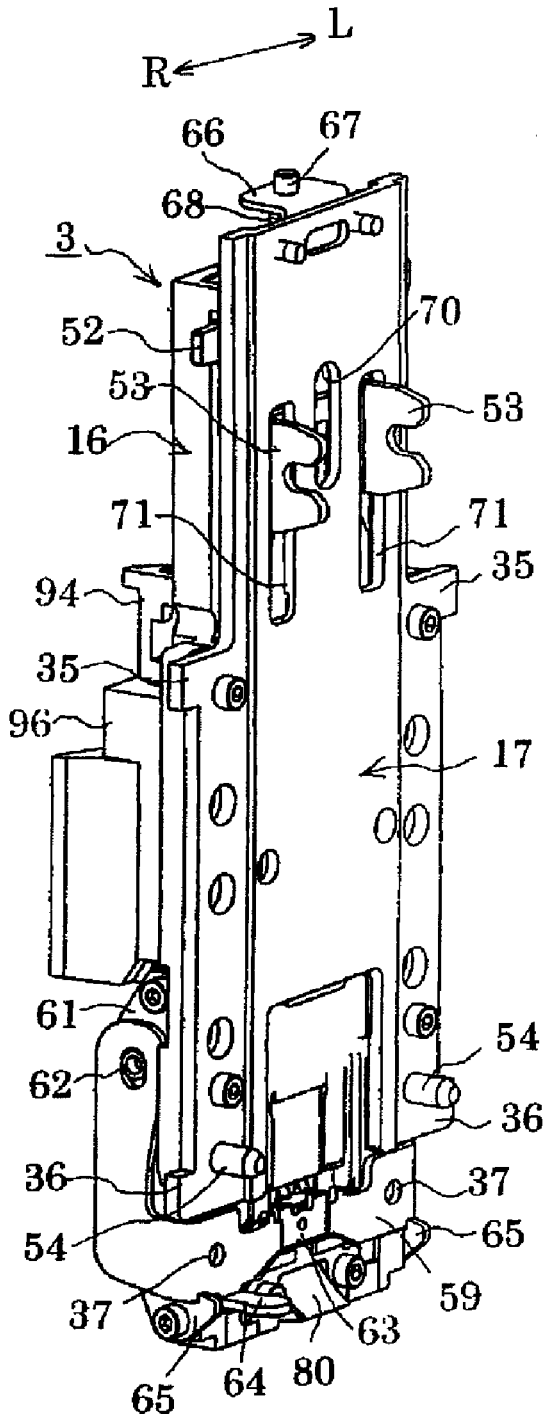
FIG. 5 is a perspective view of the back surface side of a driver assembly used in the electric stapler.

Next, description will be given below of the structure of the driver assembly 3. As shown in FIG. 5, the casing of the driver assembly 3 is formed such that a pair of front side slide guide case portion 16 and rear side guide case portion 17 are coupled to each other by a fitting pin 54 or the like. Within these guide case portions, there are mounted the forming portion 4 having the forming plate 8, driver portion 5 having the driver plate 9 and slide block portion 6 having the anvil 15 such that they can be respectively moved up and down by their required strokes. Here, a sign H shown in FIG. 12 designates the height of a magazine surface which coincides with the lower end face of the slide block portion 6.

As shown in FIG. 6, in the upper center portion of the front side slide guide case portion 16, there are sequentially formed a T-shaped hole 56, a slot 57 and a square hole 58 such that they communicate with each other. Also, in the lower center portion of the front side slide guide case portion 16, there is formed a vertically long cut-out recessed portion 60 and, in the lower edge portions of the left and right (L, R) width direction sides of the front side slide guide case portion 16, there are provided two fitting pins 54 which extend in the horizontal direction.

On the width direction two side mounting portions 61 of the front side slide guide case portion 16, there is pivotally mounted the upper portion of the face back plate 59 through a pin 62 in a rotatable manner. The right and left side lower portions of the face back plate 59 are bent inwardly so as to horizontally surround the back surface of the front side slide guide case portion 16 and, in these bent portions, there are formed a pair of right and left positioning holes 37. The right and left bent ends of the lower portion of the face back plate 59 are arranged so as to be close to each other, and between these close portions, there is provided a projecting portion 63 integrally therewith. On the lower end portion of the front side slide guide case portion 16, there are provided two lock levers 65 each with a lug 64 which are used to lock the rotation of the face back plate 59. When the lock lever 65 is lifted up using the lug 64, the locked state of the face back plate 59 can be released.

On the other hand, on the upper end side of the front surface of the rear side slide guide case portion 17, there is provided a projection 66, and on the projection 66, there is provided a slide block pusher 67. The slide block pusher 67 is constantly resiliently biased downwardly by a compression coil spring 68, while the lower end portion of the slide block pusher 67, at the top dead center thereof, is resiliently pressed against the upper end face of the slide block portion 6. In the upper portion of the rear side slide guide case portion 17, there are formed a latch slot 70 extending in the vertical direction, and slots 71, 71 for the projection 53 on the right and left sides of the latch slot 70 respectively so as to extend parallel to the latch slot 70.

Figure 7:
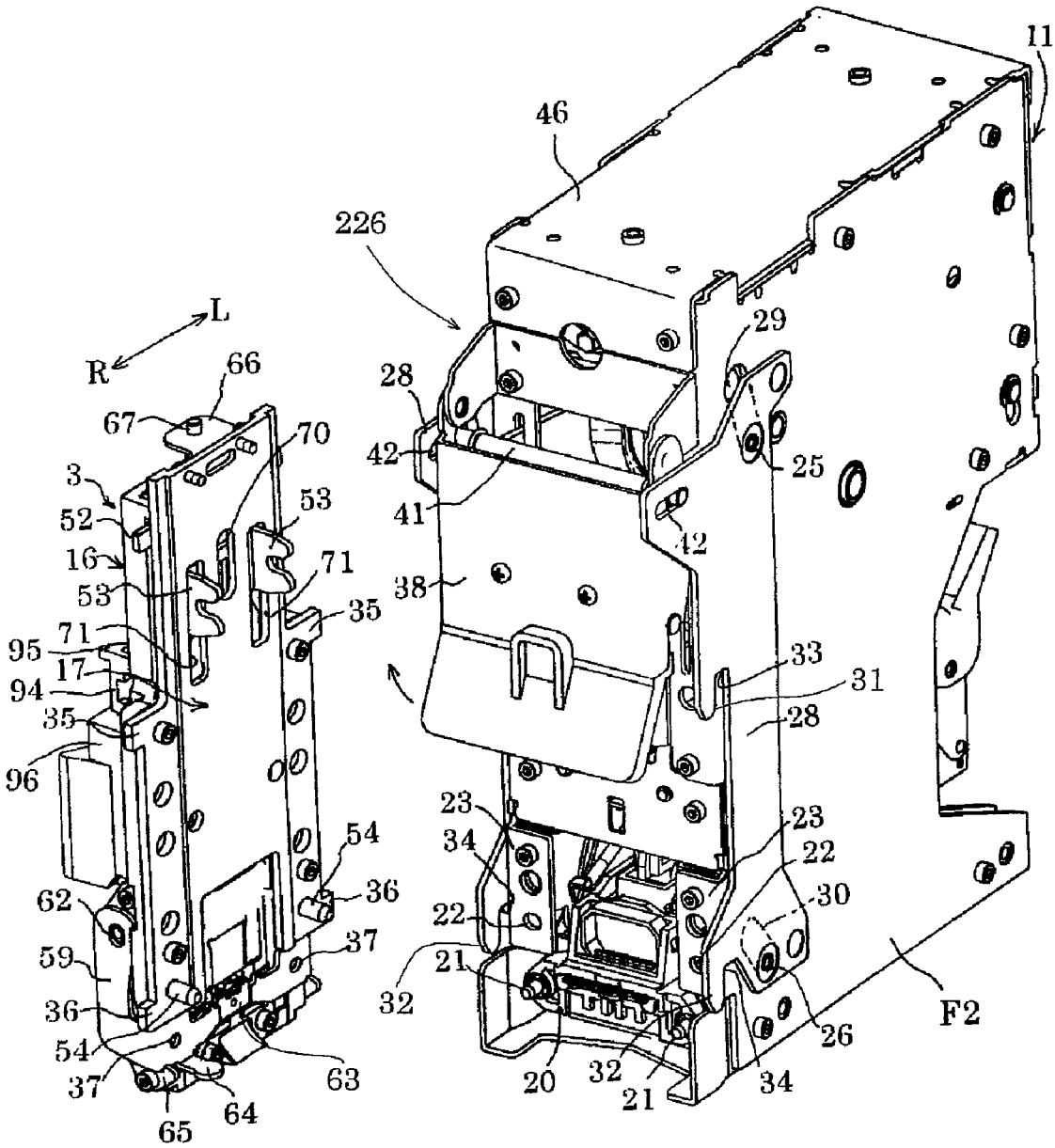
FIG. 7 is an exploded perspective view to explain a state where the driver assembly is attached to the stapler main body of the electric stapler.

In the right and left edge portions of the lower portion of the rear side slide guide case portion 17, there are opened up two pin holes 55 which correspond to the fitting pints 54 respectively. The lower end center portion of the rear side slide guide case portion 17 is cut out into a square shape. On the right and left sides of the rear side slide guide case portion 17, as shown in FIG. 7, there are provided a pair of upper projections 35, 35 and a pair of lower projections 36, 36 which respectively extend outwardly in the width direction of the slide guide case portion 17.

In the upper center portion of the slide block portion 6, there is formed a substantially I-shaped latch slot 72 which corresponds to the case side slots 56, 57 and 58. Also, in the right and left edge portions of the slide block portion 6, there are formed two recessed portions 73 which respectively extend in the vertical direction by a given dimension. On the front side upper portion of the slide block portion 6, there is mounted a slide block latch 74 in the vertical direction. The slide block latch 74 can be oscillated in the front-and-back direction F, B about a horizontal pin (see FIG. 12) which is provided in the vertical-direction middle portion of the slide block latch 74.

The lower end projection 76 of the slide block latch 74, in the wait time, is slidably contacted with the front surface of the rear side slide guide case portion 17, whereas the upper end projection 77 of the slide block latch 74 is slidably contacted with the front surface of the driver portion 5. On the front side of the upper end projection 77, there is provided a T-shaped bar 78 (see FIGS. 10A to 10E as well as FIGS. 12A to 12D) such that it can be supported on the support surface 56*a* of the T-shaped hole 56. On the front side of the lower end projection 76, there is provided a T-shaped bar 79 which can be slidably fitted into the square hole 58. Thus, the slide block latch 74 can be oscillated smoothly in the vertical direction without oscillating in the horizontal direction.

Figure 8:
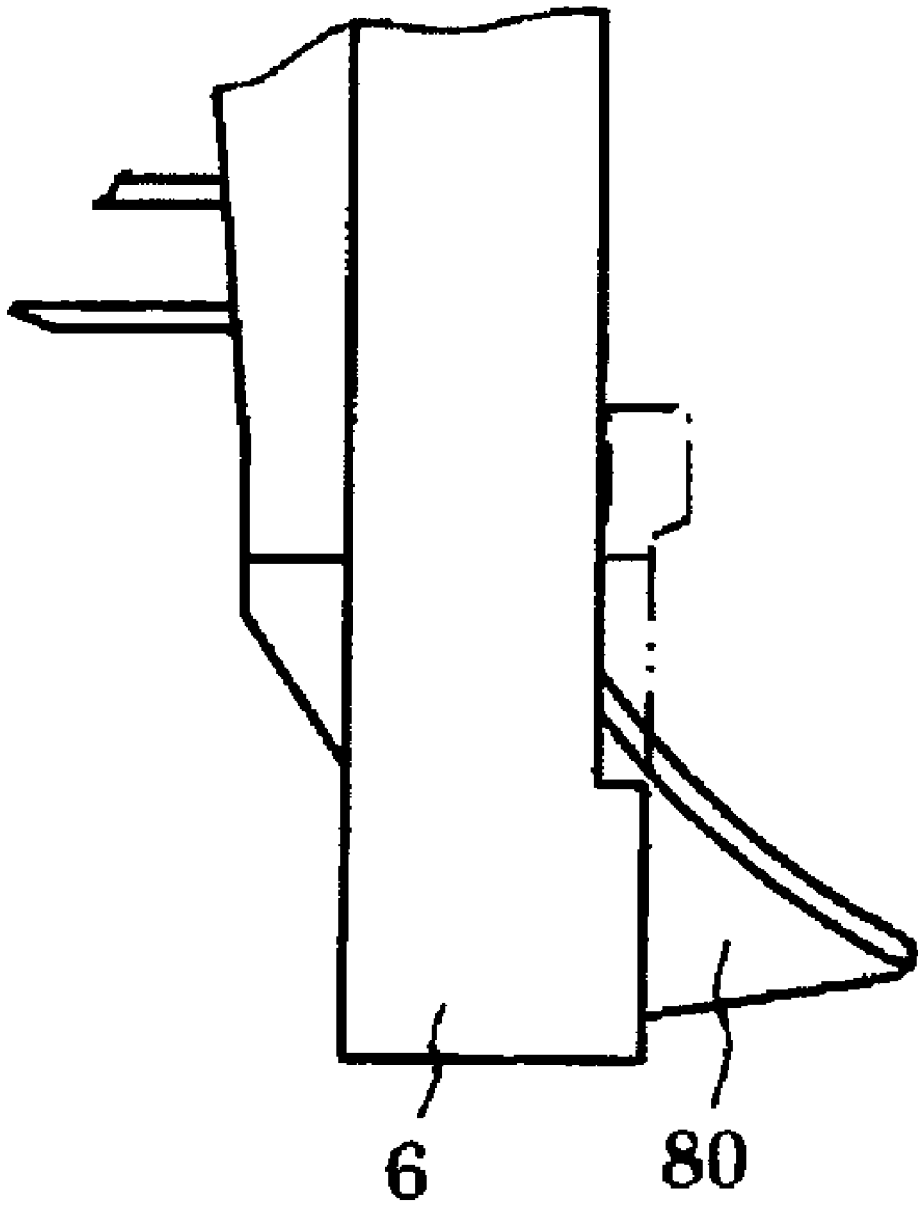
FIG. 8 is a side view of the main portions of a crown plate used in the electric stapler.
Figure 9:
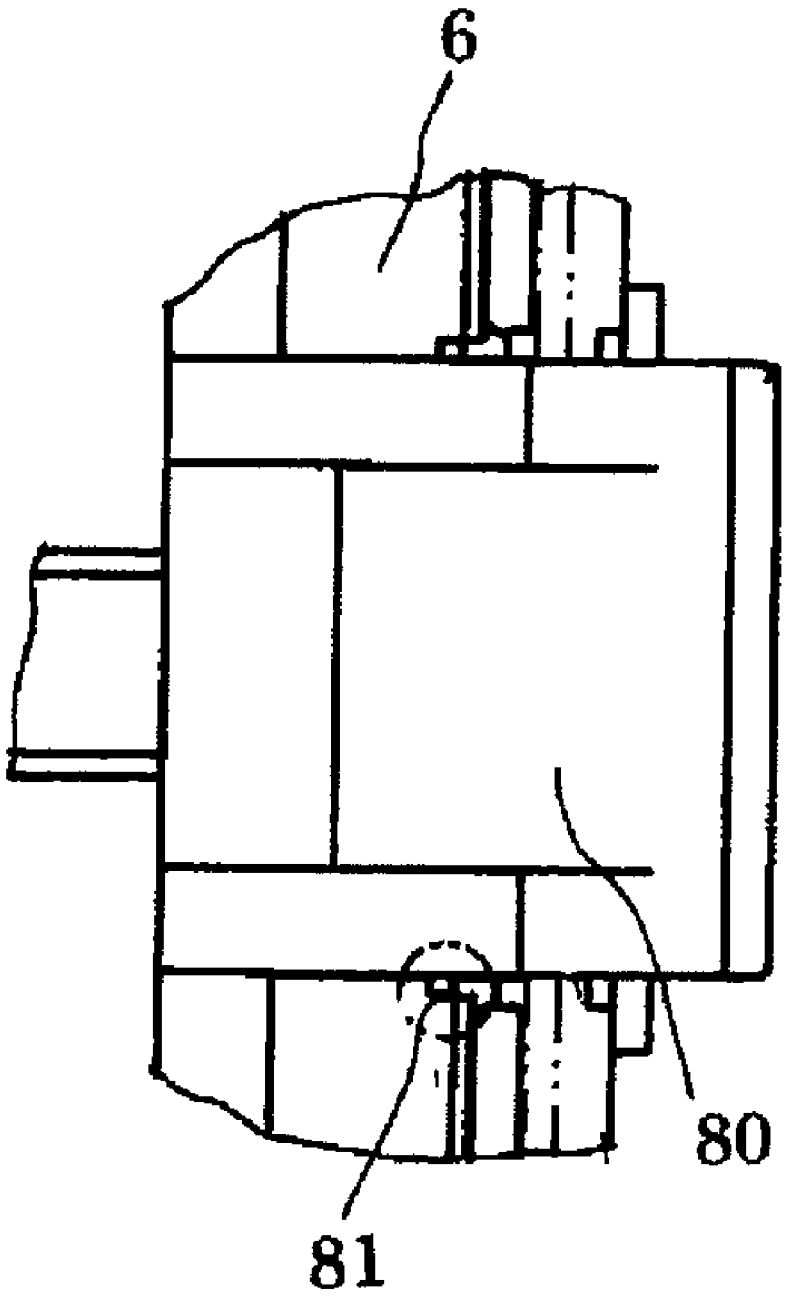
FIG. 9 is a plan view of the crown plate.

On the lower portion of the slide block portion 6, there is provided the anvil 15 such that it can be opened and closed in the front-and-back direction, while the anvil 15 serves as a bending base when the staple S is formed into a U shape using the forming plate 8. On the lower end center portion of the slide block portion 6, as shown in FIG. 8, there is provided a crown plate 80 having an upwardly inclined surface such that it can be opened and closed in the front-and-back direction, while the crown plate 80, in the staple striking completed time, is closed and is turned into a state where it hangs down. The crown plate 80, in the staple striking time, supports the crown portion of the staple S stably. Also, on the two width direction right and left sides of the crown plate 80, as shown in FIG. 9, there are formed staple passages 81 which allow the downward movement of the staple S.

As shown in FIG. 6, the driver portion 5 includes a driver holder 18 having a latch slot 82 extending in the vertical direction and a driver plate 9 mounted on the lower portion of the driver holder 18. Into the slot 82, there is slidably fitted the lower end projection 76 of the slide block latch 74. On the right and left sides of the upper end portion of the driver holder 18, there are provided projections 52 which can be engaged with the one-end side recessed portion 83 of the drive link 49, while the projections 52 are respectively allowed to move up and down within the recessed portions 73 of the slide block portion 6.

Figure 14:
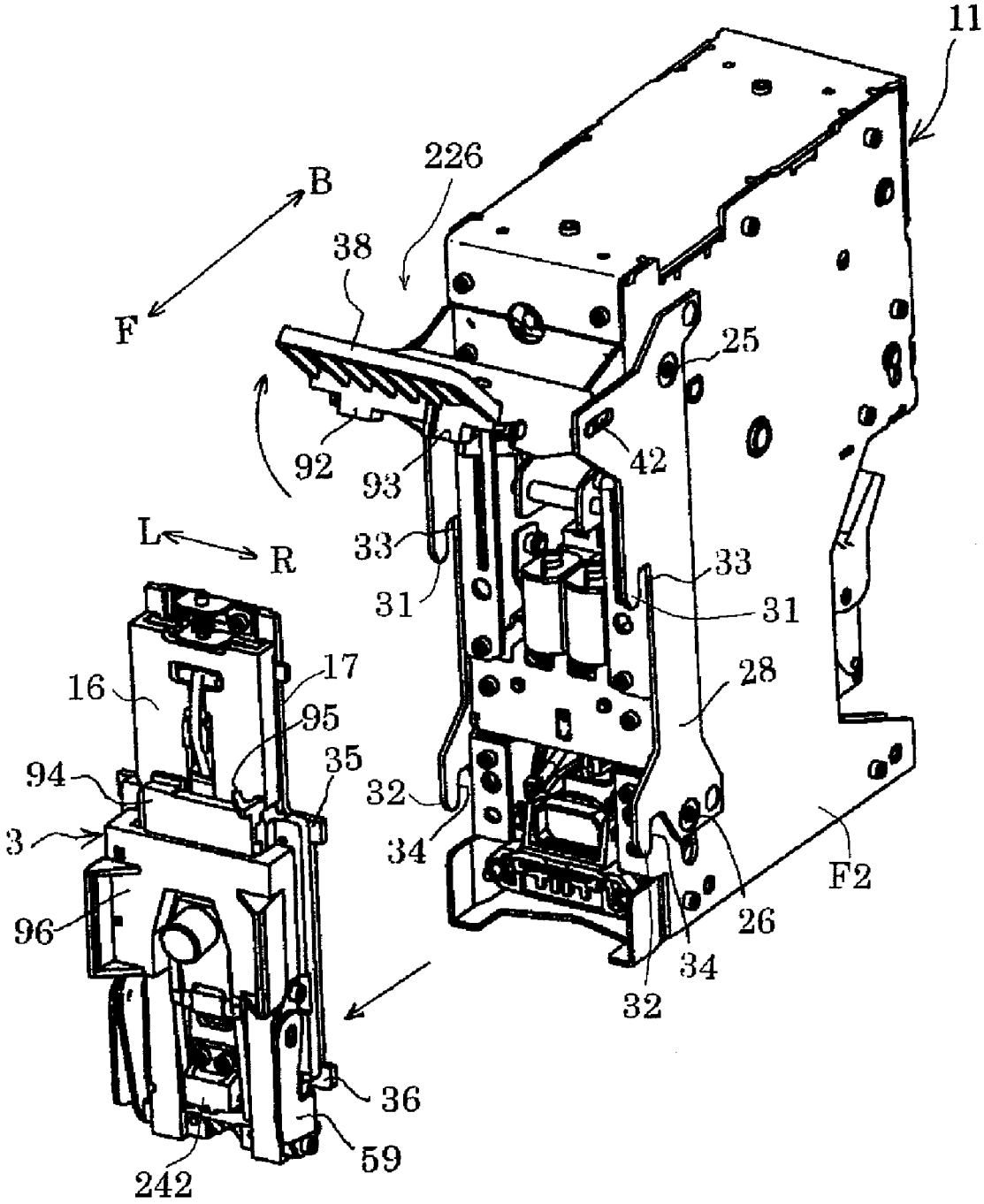
FIG. 14 is a perspective view of the stapler main body after the driver assembly is detached therefrom.

Also, as shown in FIG. 7, on the opening of the front surface of the stapler main body 11, there is provided a lever-type hold cover 38 which is used to releasably lock and fix the upper portion of the driver assembly 3. On the lower portion of the back surface of the hold cover 38, as shown in FIG. 14, there are provided a stepped portion 92 having a flat-shaped leading end face and a cam projection 93 which is situated on the right of the hold cover 38. When the hold cover 38 is closed, the stepped portion 92 not only is contacted with the front surface of a hold latch 94 (which will be discussed later) but also is pressed against a cam surface 95 to thereby drive and move the hold latch 94 in an unlocking direction R.

As shown in FIG. 4, to the upper portion of the back surface of the hold cover 38, there is connected the shaft 39 which extends in the horizontal direction, the lower end portion of the tension coil spring 40 is engaged with the shaft 39, and the upper end portion of the tension coil spring 40 is engaged with the shaft 41. The two end portions of the shaft 41 are slidably fitted into the horizontally extending slots 42 respectively formed in the upper portion of the side panels 28. When the hold cover 38 is lifted up, the side panels 28 are respectively moved along their associated slots 29, 30 (see FIG. 2), thereby releasing the engagement between the cut-out recessed portions 33, 34 and projections 35, 26. Also, since the pressure contact of the cam projection 93 with the cam surface 95 is released, the hold latch 94 is moved in the locking direction L.

As shown in FIG. 5, the casing of the driver assembly 3 is formed by coupling the front side slide guide case portion 16 and the rear side slide guide case portion 17 via the fitting pin 54 or the like. Inside the casing, the forming portion 4, driver portion 5 and slide block portion 6 are disposed such that they are respectively allowed to move up and down by their required strokes.

As shown in FIG. 6, in the upper central portion of the slide guide case portion 16, there are formed the T-shaped hole 56, slot 57 and square hole 58 while they communicate with each other. Also, in the lower central portion of the slide guide case portion 16, there is formed the cut-out recessed portion 60. On the right and left lower edge portions of the slide guide case portion 16, there are provided the fitting pins 54.

The face back plates 59 are rotatably mounted on the mounting portions 61 on respective sides of the slide guide case portion 16 by pins 62. The right and left lower portions of the face back plate 59 are bent so as to surround the back surface side of the slide guide case portion 16. In these bent portions, there are formed the positioning holes 37 respectively. The projecting portion 63 is fixed between the right and left bent end portions of the lower portion of the face back plate 59. On the lower end portion of the slide guide case portion 16, there is provided the lock lever 65 with a lug 64 which is used to lock the rotation of the face back plate 59. When the lock lever 65 is lifted up, the locked state of the face back plate 59 can be released.

On the other hand, on the projection 66 which is provided on the upper end side of the front surface of the rear side slide guide case portion 17, there is provided the slide block pusher 67. Due to the force of the compression coil spring 68, the lower end portion of the slide block pusher 67 at the top dead center can be resiliently contacted with the upper end face of the slide block portion 6. In the upper portion of the slide guide case portion 17, there are formed the vertically extending slot 70 and slots 71, 71. Also, in the two side edge portions of the lower side of the slide guide case portion 17, there are opened up the pin holes 55 respectively. On the right and left sides of the slide guide case portion 17, as shown in FIG. 7 as well, there are provided the upper projection 35 and lower projection 36 respectively.

In the upper central portion of the slide block portion 6 and in the right and left side edge portions thereof, there are formed the slot 72 and recessed portions 73 respectively, and in the lower portion and lower end central portion of the slide block portion 6, there are respectively provided the anvil 15 and crown plate 80 such that they can be opened and closed in the front-and-back direction. On the front upper portion of the slide block portion 6, there is mounted the slide block latch 74 such that it extends in the vertical direction, while the slide block latch 74 is disposed such that it can be oscillated back and forth around the horizontal pin 75 (see FIG. 12). On the lower end projection 76 and upper end projection 77 of the slide block latch 74, there are provided a T-shaped bar 78 and a T-shaped bar 79 respectively.

When the driver holder 18 is driven by the drive motor 45 through the drive cam 48 and drive link 49, it is moved up and down and, when the driver plate 9 is moved down, it cuts the U-shaped staple S and strikes it out toward the papers P. In linking with the downward and upward movements of the drive portion 5, the anvil 15 and crown plate 80 are retreated or projected with respect to the slide block portion 6 side at a given timing.

The forming portion 4 includes a forming plate 8 for forming the staple S into a U shape and a forming holder 84 for holding the upper portion of the forming plate 8. In the central portion of the forming holder 84, there is formed a latch slot 85 which extends in the vertical direction and, into the slot 85, there is slidably fitted the lower end projecting portion 76 of the slide block latch 74. On the right and left sides of the upper end portion of the forming holder 84, there are provided a pair of projections 53 such that they project horizontally, and in the leading end portion of each projection 53, there is formed a cut-out recessed portion 86. The projection 53, as shown in FIG. 7, penetrates through and is loosely fitted into its associated slot 71, and into the cut-out recessed portion 86, there is engaged a pin 51 of a drive link 50 such that it can be driven.

Figures 10A, 10B, 10C, 10D, 10E:
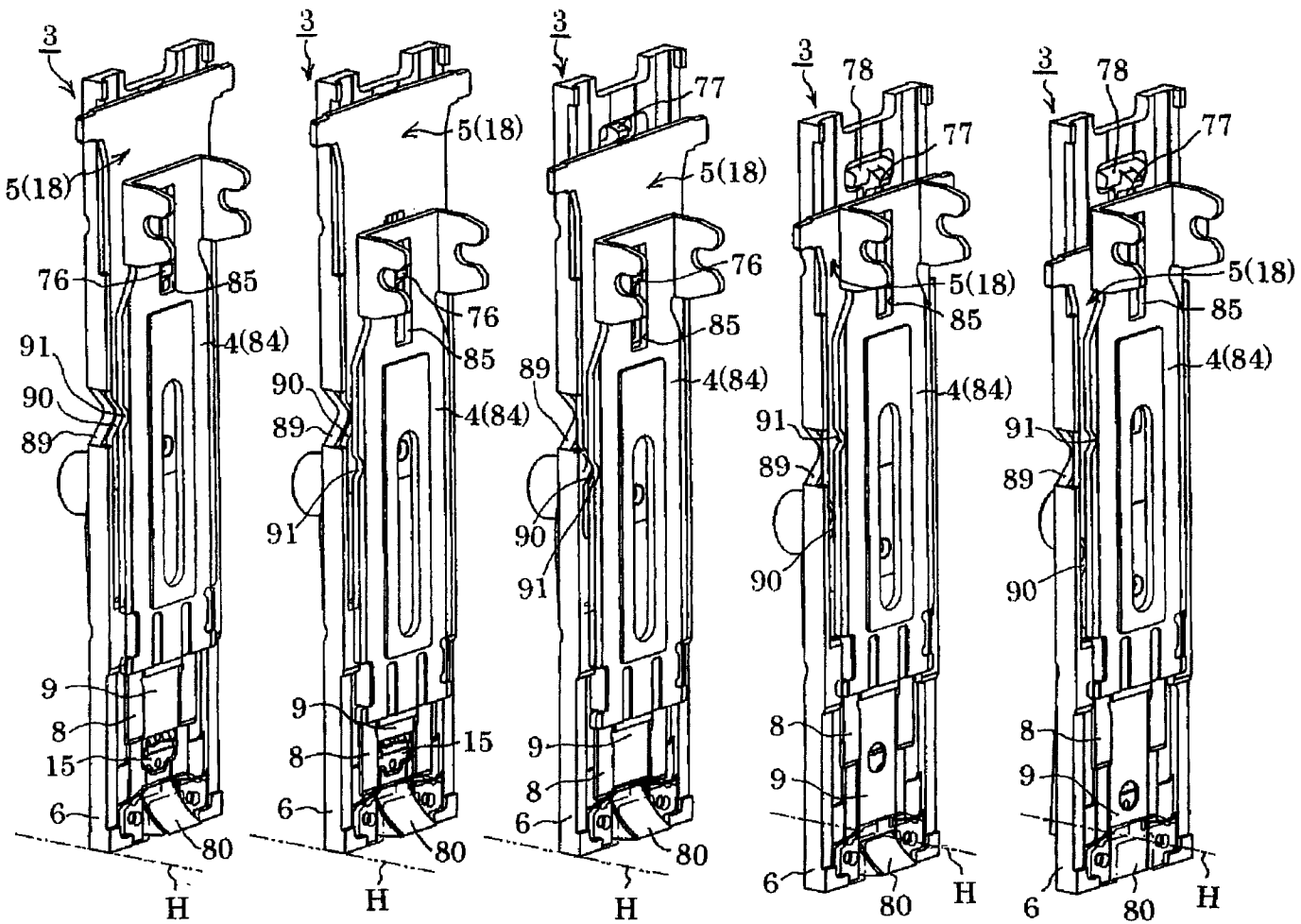
FIG. 10A is a perspective view of the driver assembly (with a guide case portion thereof omitted) in its wait time.
FIG. 10B is a perspective view of the driver assembly (with a guide case portion thereof omitted) in a forming operation.
FIG. 10C is a perspective view of the driver assembly (with a guide case portion thereof omitted) when a driver portion is lowered.
FIG. 10D is a perspective view of the driver assembly (with a guide case portion thereof omitted) in a clamping operation.
FIG. 10E is a perspective view of the driver assembly (with a guide case portion thereof omitted) when a striking operation is completed.
Figure 11:
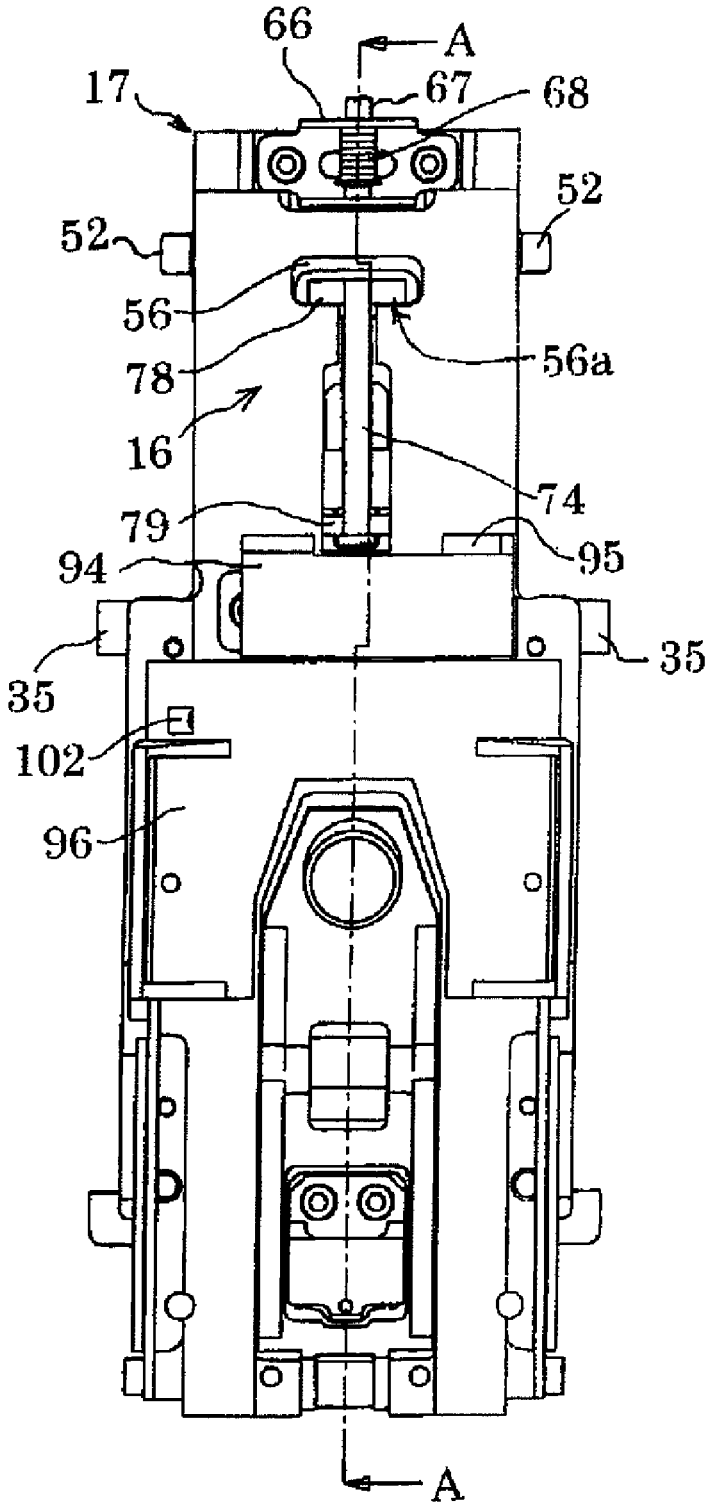
FIG. 11 is a back view of the driver assembly.

Next, description will be given below of the operation of the embodiment. Firstly, as shown in FIG. 10A, the driver assembly 3 stands by at its home position. In this stand by state, the slide block portion 6 with the anvil 15 and the like mounted thereon is situated at the top dead center, and due to the force of the compression coil spring 68, the lower end face of the slide block pusher 67 is resiliently contacted with the slide block portion 6 to bias it downwardly. Therefore, since the T-shaped bar 78 of the slide block latch 74 is contacted with and pressed against the support surface 56*a* of the T-shaped hole 56, there is no fear that the slide block portion 6 can generate rickety motion or play with respect to the slide guide case portions 16, 17 (see FIGS. 11 and 12A). Here, a sign H shown in FIGS. 10A to 10E and FIG. 12 designates the height of the magazine surface that is coincident with the lower end face of the slide block portion 6.

Figures 12A, 12B, 12C, 12D:
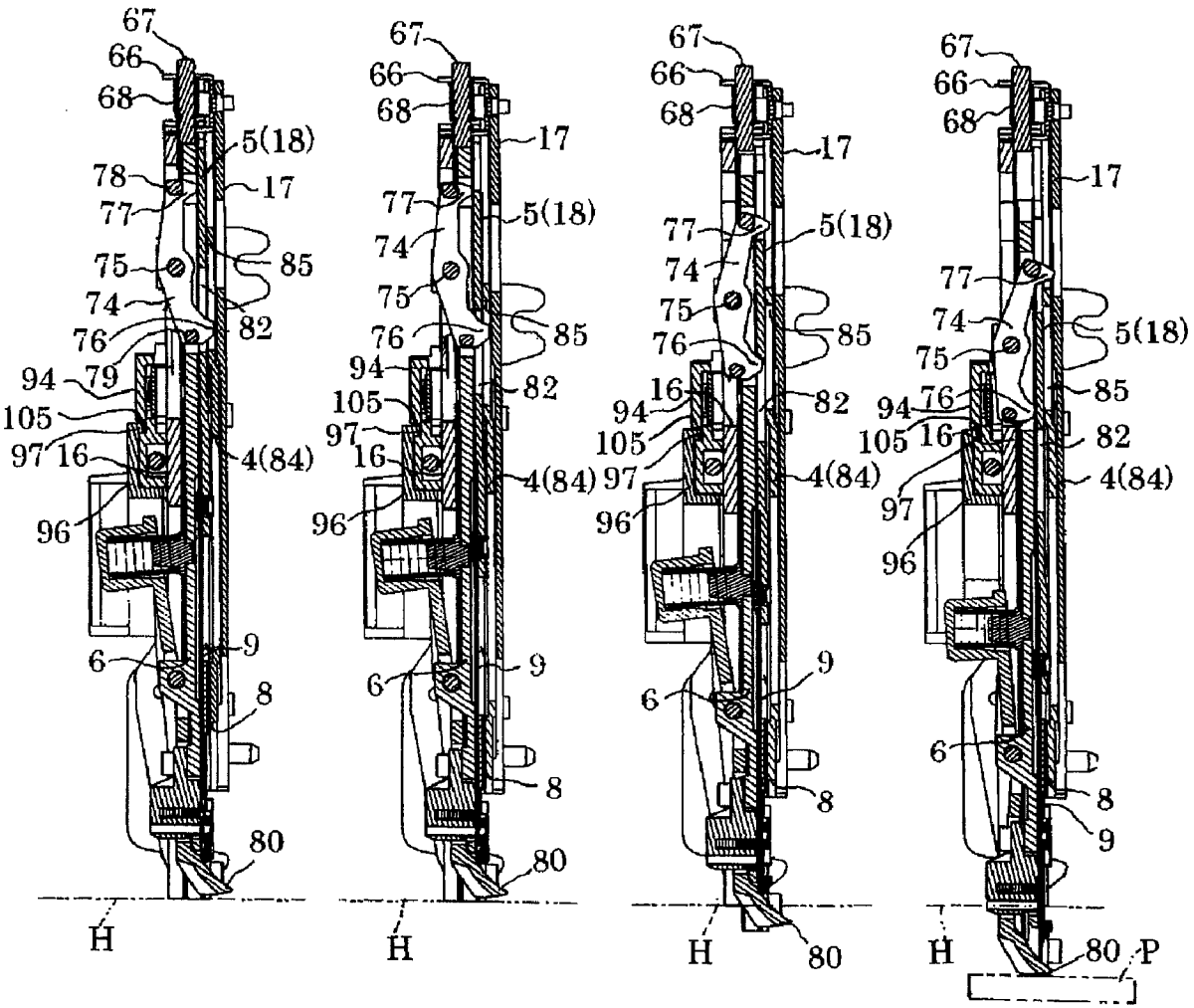
FIG. 12A is a section view of the driver assembly in a wait time, taken along the A-A arrow line shown in FIG. 11.
FIG. 12B is a section view of the driver assembly when only the driver portion is lowered, taken along the A-A arrow line shown in FIG. 11.
FIG. 12C is a section view of the driver assembly when the slide block portion is lowered, taken along the A-A arrow line shown in FIG. 11.
FIG. 12D is a section view of the driver assembly in the freely lowering time of the slide block portion, taken along the A-A arrow line shown in FIG. 11.

The lower end projecting portion of the slide block latch 74 is contacted with the front surface of the rear side slide guide case portion 17, and the upper end projecting portion of the slide block latch 74 is contacted with the front surface of the driver portion 5 (FIG. 12B). Also, staple sheets SS are fed to the driver assembly 3 side at a given timing, while the leading staple sheet SS is already formed into a U shape.

When the drive motor 45 is driven, as shown in FIG. 10B, firstly, the forming portion 4 starts to move down through the drive link 50. When the forming portion 4 moves down to a given forming position, it forms a linear-shaped staple S on the anvil 15 into a U shape. After formation of the U-shaped staple S, as the driver portion 5 moves down, the anvil 15 moves and retreats toward the slide block portion 6.

Also, when the drive motor 45 is driven, the driver portion 5 starts to move down through the drive link 49 but, at the then time, the slide block portion 6 does not start to move down yet (FIG. 12B). And, when the driver plate 9 of the driver portion 5 moves down to a given cutting position, it cuts and separates the U-shaped staple S and the cut staple is supported on the crown plate 80. Substantially at the same time when the staple is cut, the lower end projecting portion 76 of the slide block latch 74 is contacted with the upper end portion of the slot 82 and the upper end projecting portion 77 of the slide block latch 74 is detached from the support surface 56*a* of the T-shaped hole 56 (FIG. 12C).

After then, as shown in FIG. 10C, with the downward movement of the driver portion 5, the slide block portion 6 starts to move down integrally with the driver portion 5. And, as shown in FIG. 10D, when the driver portion 5 and slide block portion 6 move down to a given clamp position, the staple striking operation by the driver plate 9 is started. That is, while the crown plate 80 supporting the U-shaped staple S is rotating downward, it makes the leg portion of the U-shaped staple S penetrate through the papers P (FIG. 12D).

After then, when the driver portion 5 and slide block portion 6 move down further by a given stroke, the leg portion of the U-shaped staple S is bent along the back surface of the papers S by a movable clincher, which, as shown in FIG. 10E, completes the striking operation of the staple S.

Figure 13:
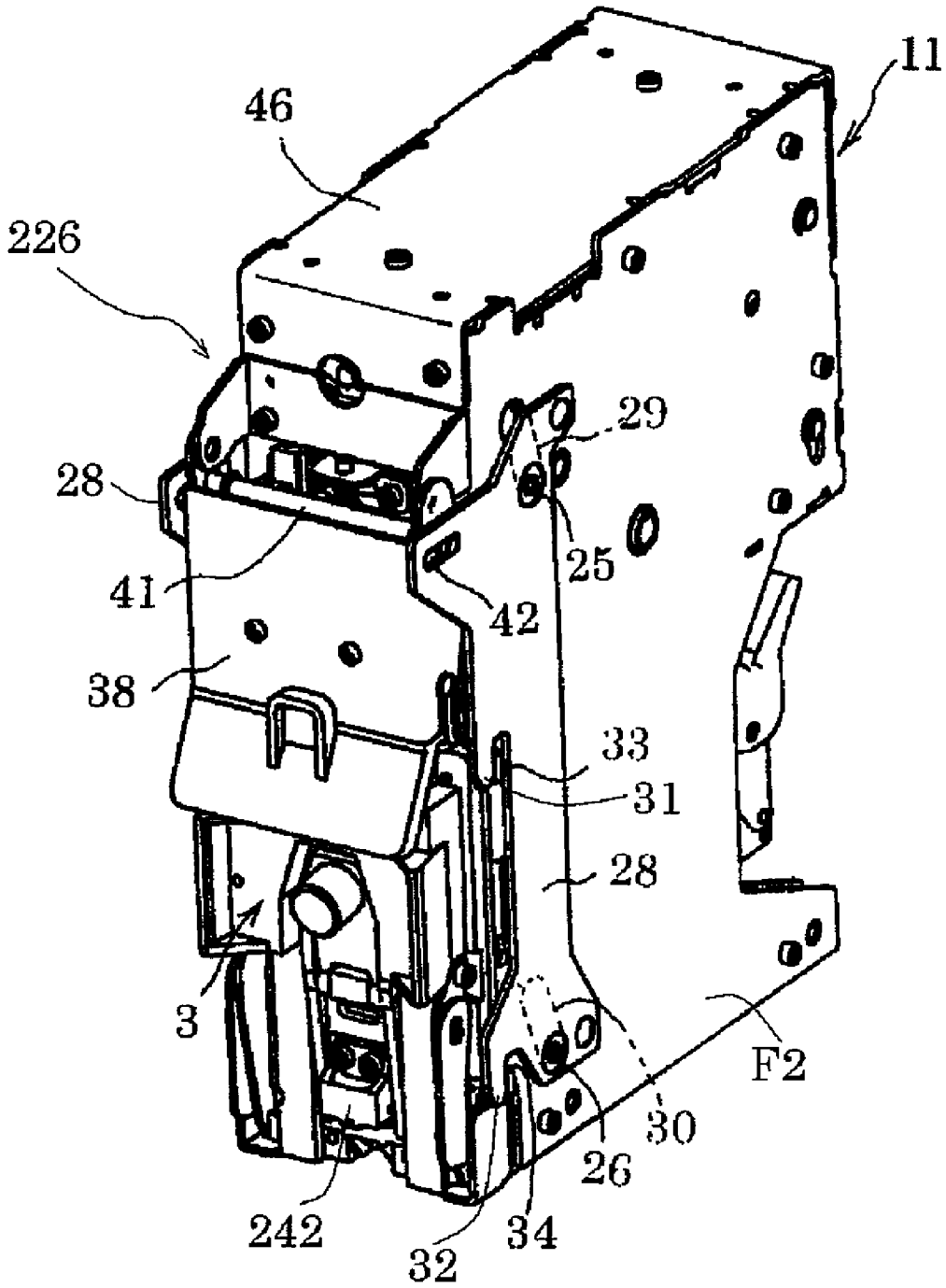
FIG. 13 is a perspective view of a stapler main body before a driver assembly is detached therefrom.

Next, description will be given below of the procedure for detaching the driver assembly 3 in the staple jam state, in the parts replacement time, in the maintenance of the electric stapler or the like. Before the driver assembly 3 is detached, as shown in FIG. 13, the upper portion of the driver assembly 3 is locked by the hold cover 38, and the projections 35, 36 of the rear side slide guide case portion 17 are respectively engaged with the cut-out recessed portions 33, 34 of the side panels 28. Also, the fitting pin 54 of the driver assembly 3 and the positioning hole 37 of the face back plate 59 are respectively fitted with the pin hole 22 of the stapler main body 11 and the pin hole 22 of the plate 23.

In a state shown in FIG. 13, when the hold cover 38 is lifted up, the shafts 39 and 41 are rotated upwardly with the horizontal shaft 43 as a fulcrum. The upward rotation of the shaft 41 moves the side panels 28 obliquely upwardly along the slots 29, to thereby release the engagement between the projections 35, 36 of the rear side slide guide case portion 17 and the cut-out recessed portions 33, 34 of the side panels 28.

Next, when the driver assembly 3 is moved linearly toward this side with respect to the front surface of the stapler main body 11, the fitting pin 54 of the driver assembly 3 and the positioning hole 37 of the face back plate 59 are respectively disengaged from the pin hole 22 and positioning pin 21 of the stapler main body 11, whereby, as shown in FIG. 14, the driver assembly 3 is detached from the stapler main body 11.

Figure 15:
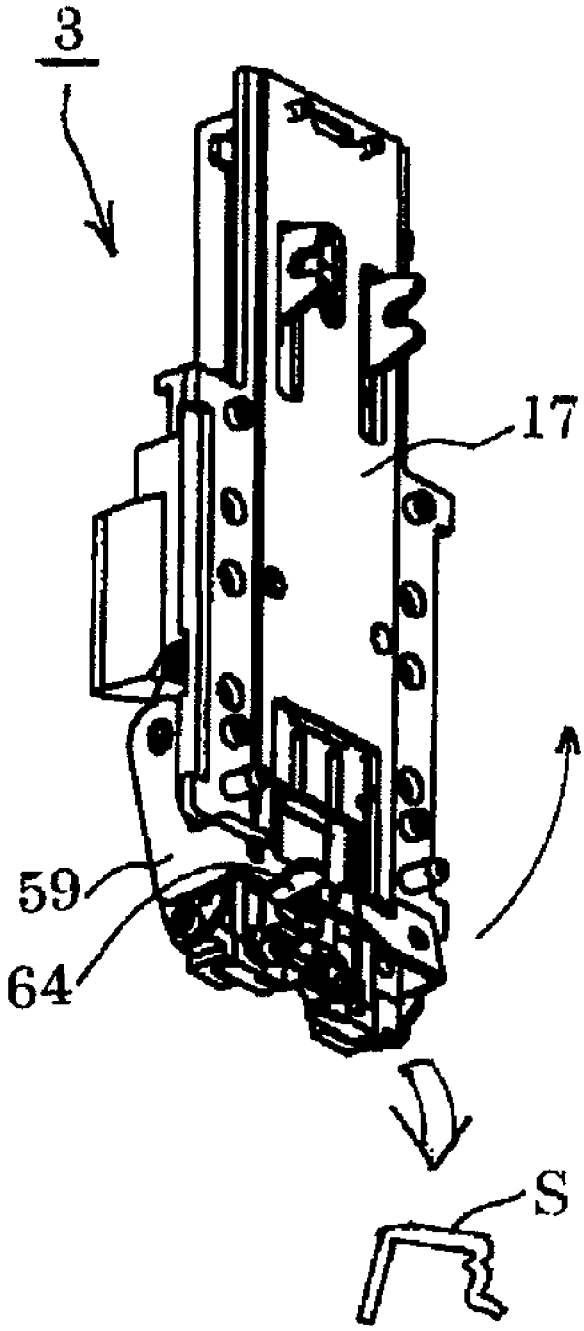
FIG. 15 is a perspective view of the driver assembly, showing the back surface side thereof.
Figure 16A:
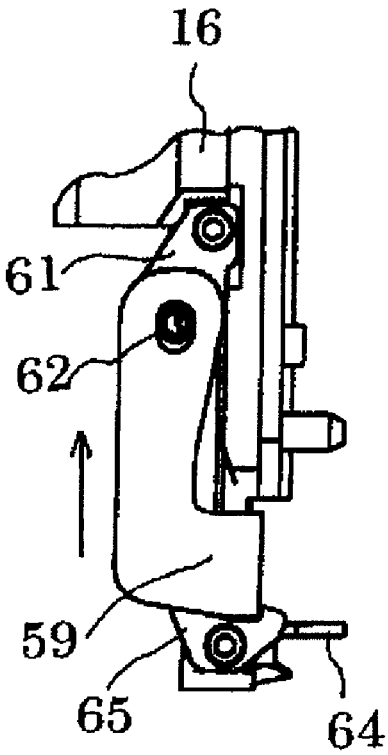
FIG. 16A is a perspective view of the lower end portion of a slide block portion before the locked state of a face back plate is released.
Figure 16B:
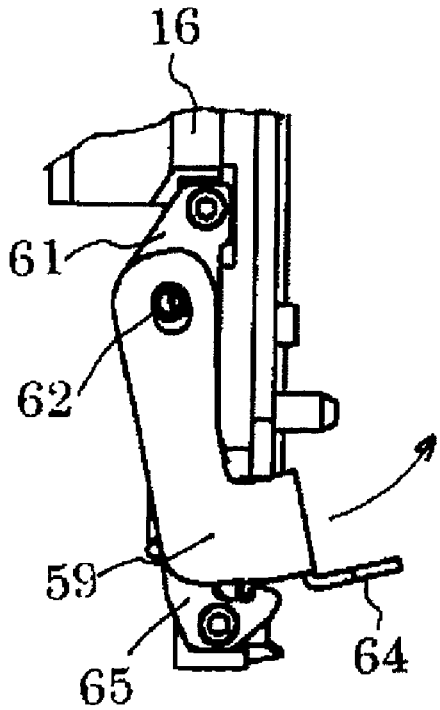
FIG. 16B is a perspective view of the lower end portion of the slide block portion after the locked state of the face back plate is released.

Thereafter, for example, when removing the staple S that is jammed inside the openable and closable face back plate 59, that is, when executing a staple jam processing, by releasing the locking of the rotation of the face back plate 59 and lifting up the lug 64, as shown in FIG. 15, the staple S can be removed easily. That is, when the locked state of the face back plate 59 shown in FIG. 16A is released and, as shown in FIG. 16B, the face back plate 59 is rotated upwardly using the lug 64, the projecting portion 63 of the face back plate 59 is released to thereby be able to remove the staple S easily.

According to the embodiment, the forming portion 4, driver portion 5, and slide block portion 6 including the anvil 15 and crown plate 80, which are respectively parts involved with the staple forming and striking operations, are integrated into a unit, and this unit is incorporated into the slide guide case portions 16, 17 such that it is movable by a required stroke, thereby forming the driver assembly 3. The driver assembly 3 is detachably attached on the front surface of the stapler main body 11. Therefore, the operation to change the crown width of the staple, the operation to replace parts and the maintenance operation including cleaning can be carried out easily simply by detaching the driver assembly 3.

For example, when a part is damaged, simply by detaching the driver assembly 3 and replacing the damaged part with a new one, the damage part can be recovered to the normal condition. Also, when changing the crown width of the staple, since the slide block portion with the crown plate 80 can be replaced quickly, the crown width of the staple can be changed easily and quickly.

Especially, the slide guide case portions 16, 17 of the driver assembly 3 can employ the fitting pin and link lever as the mechanism thereof for positioning as well as attaching and detaching them, and thus they can be attached and detached linearly on the front surface of the stapler main body 11. That is, simply by linearly moving the slide guide case portions 16, 17 back and forth on the front surface of the stapler main body 11, the slide guide case portions 16, 17 can be attached and detached linearly, which not only can enhance the operation efficiency of the electric stapler greatly but also can minimize influences on the casing that supports the electric stapler.

In other words, since the attaching and detaching direction of the driver assembly 3 is the front-and-back direction on the front surface of the stapler main body 11, the attaching and detaching operation is easy to understand, thereby being able to prevent the wrong attaching and detaching operation. In addition, there is reduced the dead space that is necessary for the operation, which decreases the limits on the casing side and thus increases the freedom of the design of the electric stapler.

The driver assembly 3 includes the driver plate 9 up to the openable and closable face back plate 59 and anvil 15, and thus there is formed the staple passage that can be opened and closed. Thus, a series of operations including the staple forming and striking operation can be carried out smoothly with high efficiency.

Some of the parts such as the face back plate 59 and the anvil 15 may also be disposed not on the driver assembly 3 side but on the stapler main body 11 side such that these parts are detachable after detaching the driver assembly 3.

Further, the slider block portion 6 includes the slide block latch 74 which can be fitted into the slot 82 of the driver portion 5 such that it can be moved in the vertical direction. Since the slide block latch 74 is engaged with the end portion of the slot 82 according to the driving timing of the driver portion 5, the slide block portion 6 can be driven only by a given stroke in linking with the driving of the driver portion 5. For example, in the staple striking time, since the lower end projecting portion 76 of the slide block latch 74 is engaged with the upper end portion of the slot 82, the slide block portion 6 is driven and lowered in linking with the lowering movement of the driver portion 5. By the way, in the rising time of the driver portion 5, according to the reversed operation to the above-mentioned operation, the slide block portion 6 is driven and raised in linking with the movement of the driver portion 5.

Because the slide block latch 74 is provided to couple or to decouple the slide block portion 6 and driver portion 5 at certain operation timing, there can be reduced the number of drive members such as a drive cam and a drive link, which not only can reduce the size of the electric stapler but also can reduce the number of parts used in the electric stapler.

According to a conventional method, in order to drive the slide block portion 6 using independent drive means, there are necessary a drive cam and a drive link that are produced exclusively for this purpose, thereby increasing the space for provision thereof and the number of parts used in an electric stapler. On the other hand, the embodiment can solve this problem. That is, since, after the staple is cut, together with the driver portion 5 that is driven by the drive motor 45, the slide block portion 6 is also driven integrally, there is eliminated the need for use of independent drive means produced exclusively for the slide block portion 6. There are required only two kinds of drive links, one for the forming portion 4 and the other for the driver portion 5. This can reduce the space and cost accordingly.

When the slide block portion 6 is situated at the top dead center, the operation range of the drive link 49 is set slightly above the top dead center of the slide block portion 6. However, the T-shaped bar 79 of the slide block pusher 67 is pressed against the fix surface (the support surface 56*a* of the T-shaped hole 56) due to the force of the compression coil spring 68. Therefore, there is no fear that the slide block portion 6 can generate rickety motion or play with respect to the slide guide case portion 16 and stapler main body 11. This can enhance the relative position precision between the anvil 15 and the main body side staple passage 81, thereby being able to realize accurate positioning.

Figure 17:
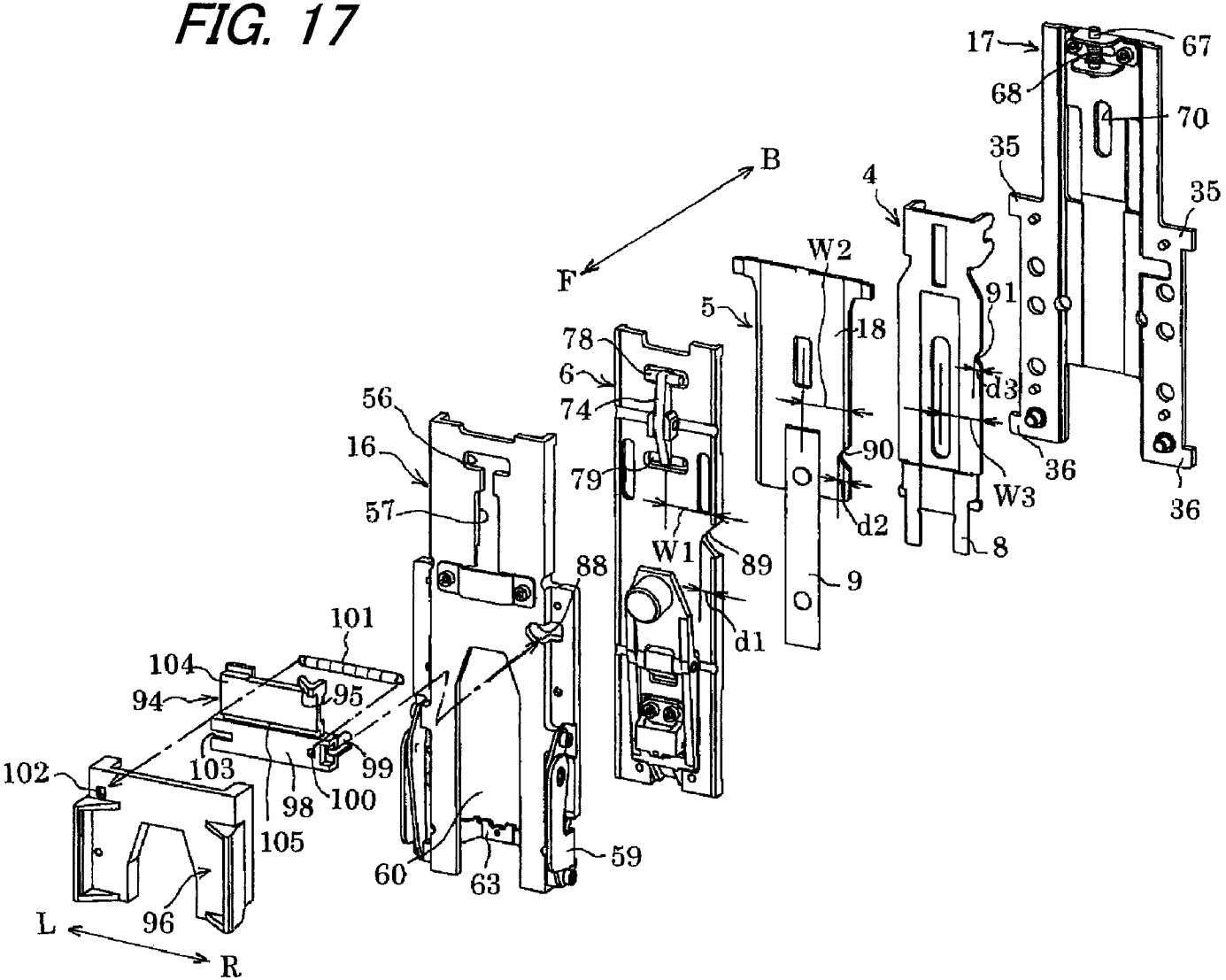
FIG. 17 is a perspective view of the driver assembly, when it is disassembled and viewed from ahead.

Next, description will be given in detail of the lock mechanism and unlock mechanism that are provided in the driver assembly 3. As shown in FIG. 17, in the right side portion (right direction R side portion) of the front side slide guide case portion 16, there is formed a pin penetration hole 88, while the penetration hole 88 is set at a height position that corresponds to the height between the slot 57 and cut-out recessed portion 60 of the front side slide guide case portion 16. Also, in the respective right side portions of the slide block portion 6, driver portion 5 and forming portion 4 that correspond to the penetration hole 88, there are formed engaging grooves 89, 90, 91 respectively.

These engaging grooves 89, 90, 91 are formed such that the depths thereof increase in correspondence to the left and right direction (L, R) width dimensions of the forming portion 4, driver portion 5 and slide block portion 6, that is, in order of the engaging grooves 89, 90, 91. Here, where the half width dimensions of the slide block portion 6, driver portion 5 and forming portion 4 are expressed as W1, W2 and W3 respectively, the depth d3 of the engaging groove 91, the depth d2 of the engaging groove 90 and the depth d1 of the engaging groove 89 satisfy the relational expressions, d2=d3+(W2−W3) and d1=d2+(W1−W2). Therefore, the positions of the respective inside bottom surfaces of the three engaging grooves 91, 90 and 89 coincide with each other in the right and left width direction (see FIGS. 17 and 19).

To the front surface side of the front side slide guide case 16, there is fixed a latch hold member 96 having a C shape when it is viewed from above and, on the back surface of the latch hold member 96, as shown in FIG. 12, there is provided a projecting rail portion 97 which extends in the left and right width directions L, R. Between the latch hold member 96 and front side slide guide case portion 16, there is interposed a hold latch 94. In the front surface of the hold latch 94, there is formed a recessed groove 105 which has a C-shaped cross section and extends in the width directions (L, R), and the recessed groove 105 is slidably fitted with the rail portion 97.

As shown in FIG. 17, on the right side portion of the lower portion 98 of the hold latch 94, there is provided a lock pin 99 which extends toward the front side slide guide case portion 16. In the vicinity of the lock pin 99, there is formed an engaging portion 100, and a portion of a tension coil spring 101 is engaged with the engaging portion 100. The other end portion of the tension coil spring 101 is engaged with an engaging portion 102 which is formed on the latch hold member 96. Also, in the left side portion of the hold latch 94, there is formed a cut-out portion 103 for a spring.

The tension coil spring 101 always biases the hold latch 94 against the latch hold member 96 in the locking direction L of the lock pin 99. When the hold cover 38 is lifted up and is opened, the cam projection 93 (see FIG. 14) of the hold cover 38 is disengaged from the cam surface 95 (which will be discussed later) so that the lock pin 99 is moved in the locking direction L by the force of the tension coil spring 101 and is engaged with the engaging grooves 89, 90, 91.

Figure 18:
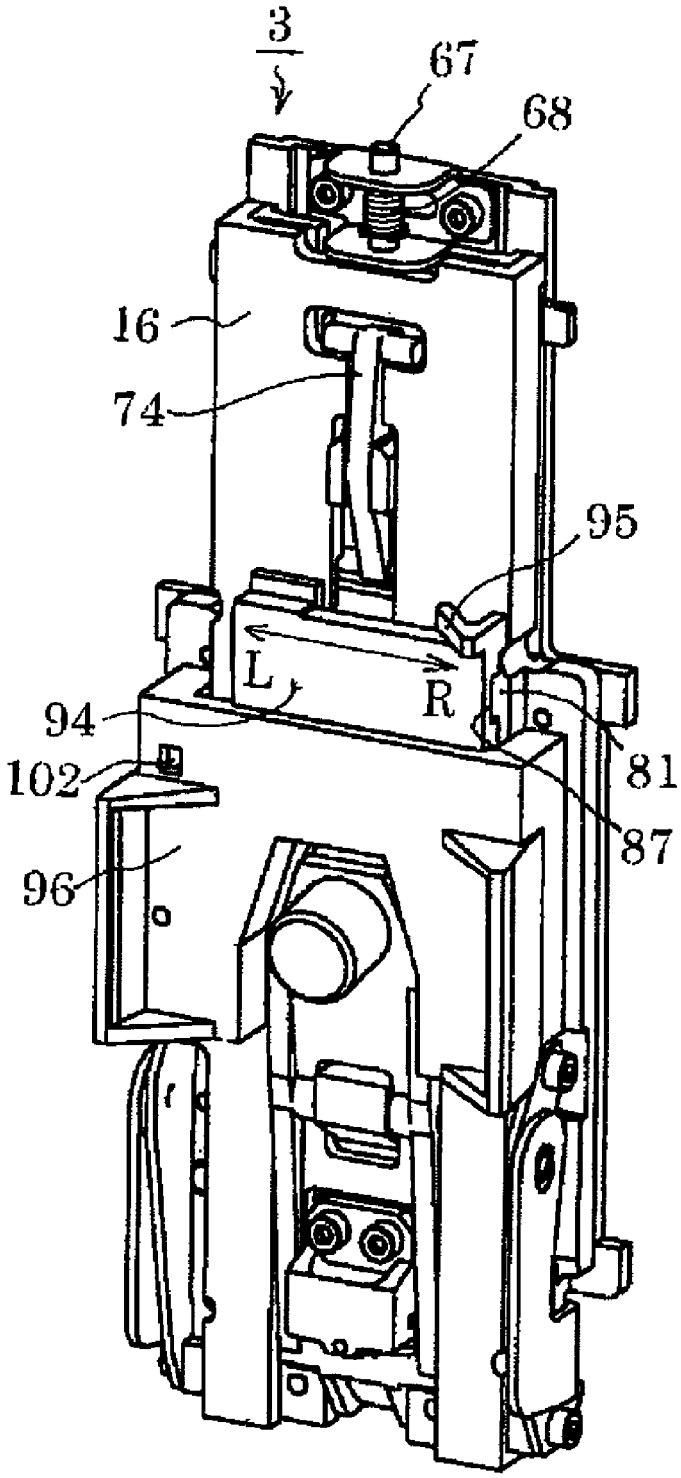
FIG. 18 is a perspective view of the driver assembly shown in FIG. 17, when it is viewed from ahead.
Figure 19:
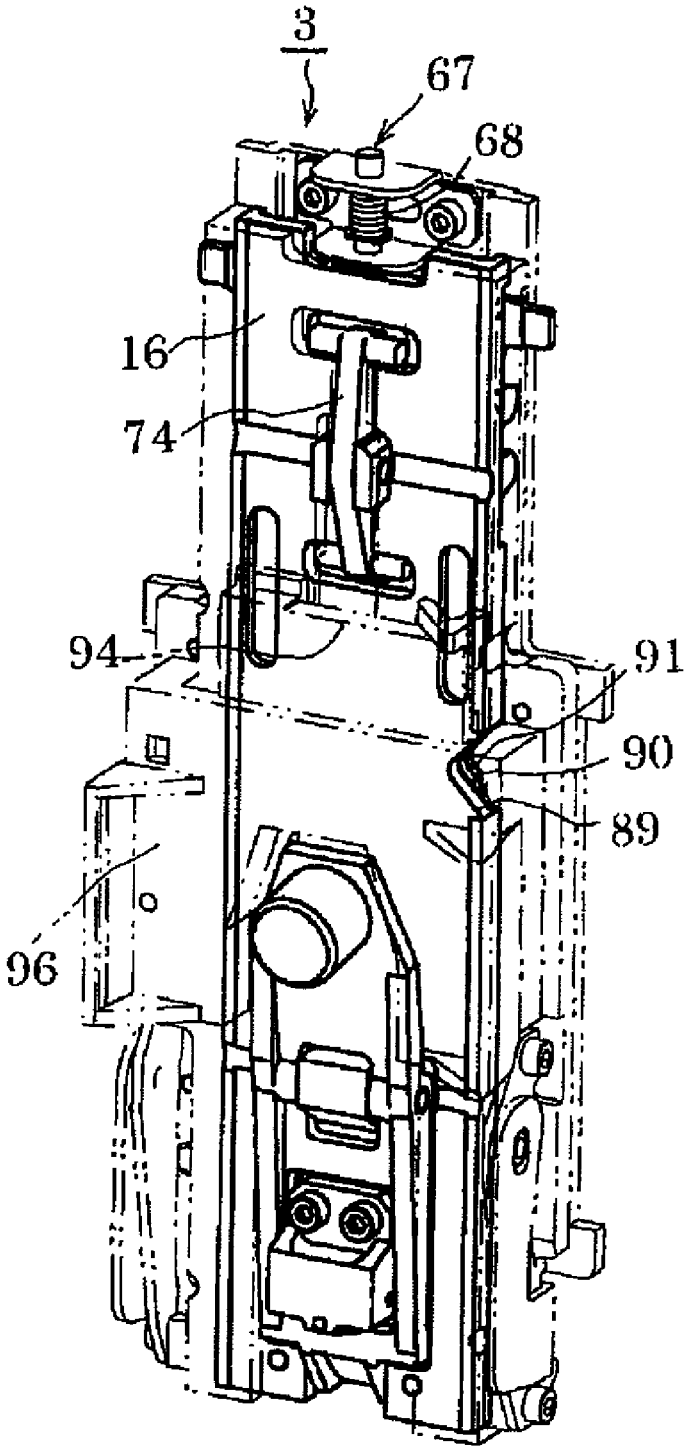
FIG. 19 is a perspective view of the driver assembly shown in FIG. 18, showing a state where a latch hold member is detached therefrom.

As shown in FIGS. 17 and 18, in the vicinity of the right side portion of the upper portion 104 of the hold latch 94, there is formed the cam surface 95 having a substantially V shape when it is viewed from above. As the cam surface 95 goes in the locking direction L of the hold latch 94, it is inclined toward the front side slide guide case portion 16. When the hold cover 38 is closed, by pushing the cam surface 95 using the cam projection 93, the lock pin 99 is separated from the engaging grooves 89, 90, 91 to thereby release the locked state.

According to the driver assembly 3 including the above-mentioned lock mechanism and unlock mechanism, when detaching the driver assembly 3 at the home position from the stapler main body 11, if the hold cover 38 is lifted up and is thereby opened, the cam projection 93 of the hold cover 38 is separated from the cam surface 95, whereby the hold latch 94 is slid in the locking direction L due to the force of the tension coil spring 101. Accordingly, the lock pin 99 of the lock mechanism is engaged with the engaging grooves 89, 90, 91, so that the slide block portion 6, driver portion 5 and forming portion 4 are locked and fixed at their respective regular positions (home positions) with respect to the slide guide case portion 16.

When the hold cover 38 is pushed up, in some cases, the forming portion 4, driver portion 5 and slide block case portion 6 are not returned back to their home positions. In such cases, the forming portion 4, driver portion 5 and slide block case portion 6 can be manually returned to their home positions and can be thereby locked and fixed. That is, since the engaging groove 91 of the forming portion 4, the engaging groove 90 of the driver portion 5 and the engaging groove 89 of the slide block portion 6 increase gradually in the groove depth in this order (in order of the sizes of the right and left width dimensions), the slide block portion 6, driver portion 5 and forming portion 4 can be returned step by step to their respective home positions in this order and can be thereby locked.

For example, when none of the slide block portion 6, driver portion 5 and forming portion 4 are returned to their regular home positions, firstly, the slide block portion 6 is raised up to its regular home position. As a result of this, the lock pin 99 is moved in the locking direction L due to the tension coil spring 101 and is thereby engaged with the engaging groove 89. In this engaged state, since the lock pin 99 is contacted with the right end face of the driver portion 5, the lock pin 99 is not moved down to the inner bottom portion of the engaging groove 89. The distance between the inner bottom portion of the engaging groove 89 and lock pin 99 corresponds to the depth d2 of the engaging groove 90 of the driver portion 5.

Next, when the driver portion 5 is raised up to its regular home position, the lock pin 99 is moved in the locking direction L and is thereby engaged with the engaging groove 90. In this engaged state, since the lock pin 99 is contacted with the right end face of the forming portion 4, the lock pin 99 is not moved down to the inner bottom portion of the engaging groove 90. The distance between the inner bottom portion of the engaging groove 89 and lock pin 99 corresponds to the depth d3 of the engaging groove 91 of the forming portion 5.

Finally, when the forming portion 4 is raised up to its regular home position, the lock pin 99 is moved further in the locking direction L and is thereby engaged with the engaging groove 91. As a result of this, the lock pin 99 is moved down to the inner bottom positions of the three engaging grooves 89, 90, 91, whereby the slide block portion 6, driver portion 5 and forming portion 4 are locked and fixed at their regular home positions by a single lock pin 99. By the way, even when neither the driver portion 5 nor forming portion 4 is returned to its home position or only the forming portion 4 is not returned to its home position, the three portions can be locked at their home positions similarly according to the above-mentioned procedure.

In this manner, when detaching the driver assembly 3, the slide block portion 6, driver portion 5 and forming portion 4 are locked at their respective regular home positions with respect to the slide guide case portion 16, thereby being able to positively prevent these portions from being shifted in position. In this case, it is not necessary to return the forming portion 4, driver portion 5 and slide block portion 6 to their home positions at the same time, but they can be returned step by step to their home positions and can be locked easily and quickly.

Thereafter, when the driver assembly 3 is attached to the stapler main body 10 and is used, the driver assembly 3 is mounted at a given position within the stapler main body 10, and the hold cover 38 is pushed down and is closed, so that the locked state of the slide block portion 6 and the like by the lock pin 99 can be released automatically. Now, when the drive assembly 3 is attached to the stapler main body 10 and the hold cover 38 is pushed down to its closed position, the cam projection 93 provided on the back surface of the hold cover 38 is pressed against the cam surface 95 of the unlock mechanism to move it in the unlock direction R, whereby the lock pin 99 is also moved in the unlock direction R.

Thus, the lock pin 99 is disengaged from the three engaging grooves 89, 90, 91, so that the slide block portion 6, driver portion 5 and forming portion 4 are turned into the unlock state in which they can be driven. Therefore, there is eliminated the need for an operator to execute the manual operation to release the locked states of the slide block portion 6, driver portion 5 and forming portion 4 each time the operator mounts the driver assembly 3, thereby being able to positively prevent the wrong operation of these portions. And, the interior movable parts such as the driver portion 5 can be moved smoothly without receiving the force of the tension coil spring 101, which can prevent the interior movable parts from being damaged due to wear or the like.

As shown in FIG. 3B, in the upper portion of the frame F2, there is disposed a driver drive device 204 and, in the lower portion of the frame F2, there is disposed the staple feed assembly 10. The driver drive device 204 drives, that is, moves up and down the driver and forming portion (not shown) of the driver assembly 3 mounted on the front surface (in FIG. 3B, the left surface) of the frame F2. The staple feed assembly 10 jets out a staple, which is to be supplied just below the driver of the driver assembly 3, toward the clincher portion 7 shown in the lower portion of FIG. 1, and the clincher of the clincher portion 7 bends inwardly the leg portion of the staple that has penetrated through a stack of papers, thereby binding the paper stack.

Figure 20A:
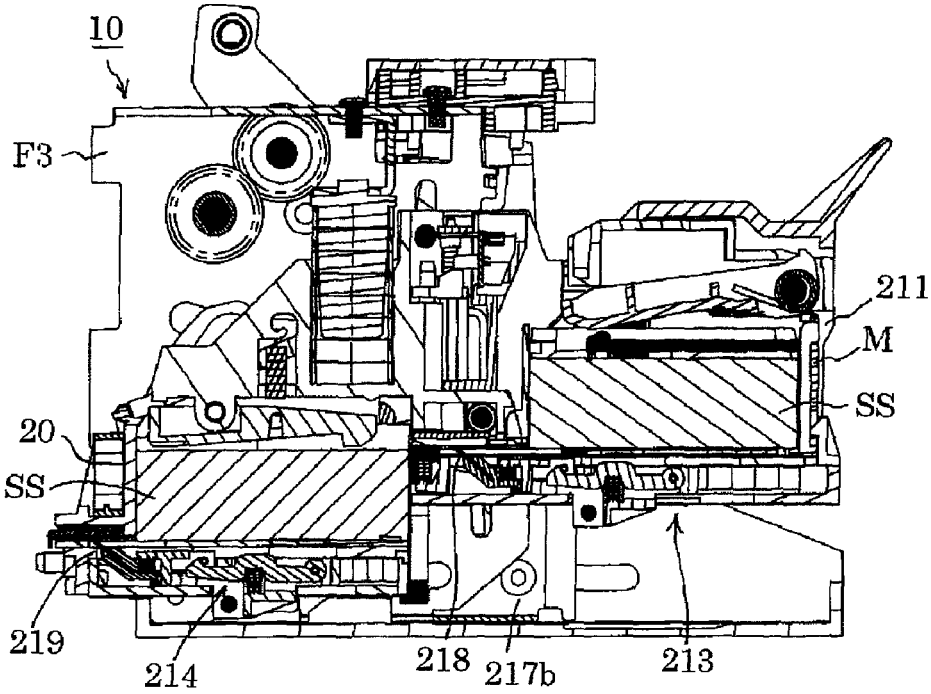
FIG. 20A is a side section view of a staple feed assembly.
Figure 20B:
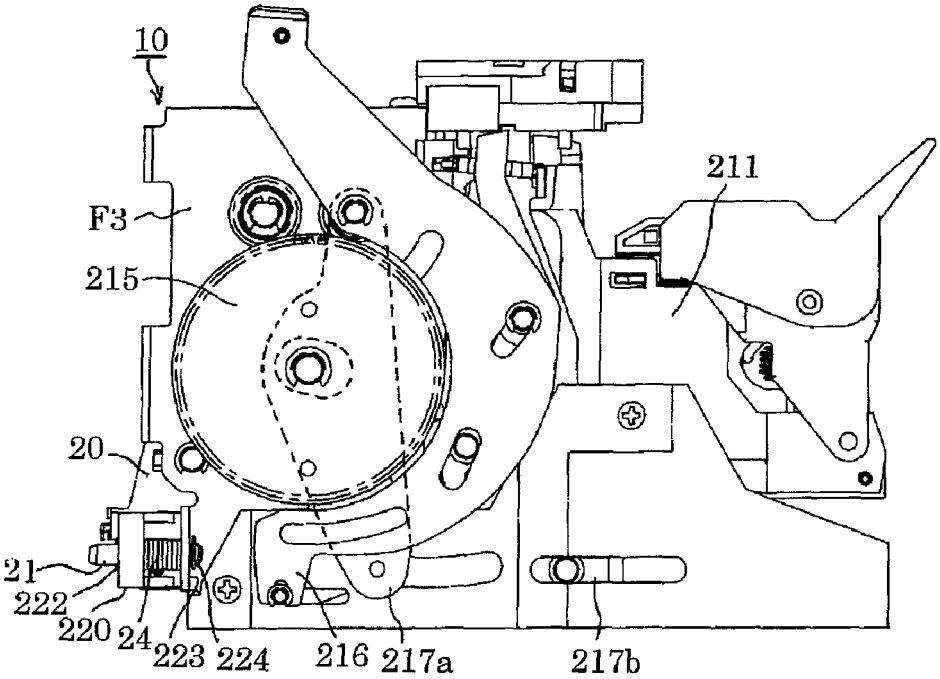
FIG. 20B is a side view of the staple feed assembly.

FIG. 20 shows the staple feed assembly 10 which is disposed in the lower portion of the stapler main body 11. As shown in FIG. 20A, in the rear portion (in FIG. 20A, the right portion) of a feed device frame F3, there is disposed a magazine storage portion 211 and, in front of the magazine storage portion 211, there is disposed a staple sheet storage portion 20. In the respective lower surfaces of the magazine storage portion 211 and staple sheet storage portion 20, there are provided a first staple feed mechanism 213 and a second staple feed mechanism 214. The staple feed mechanism 214 can be reciprocated, that is, can be moved back and forth by a staple feed cam lever 216 which can be driven by a disk cam 215 (having a cam groove formed in the back surface thereof) shown in FIG. 20B. Also, the staple feed mechanism 213 can be reciprocated, that is, can be moved back and forth by a feed link arm 217*a* shown by a broken line in FIG. 20B and a feed link 217*b*.

The feed pawls 218, 219 of the two staple feed mechanisms 213 and 214, in the backward movements thereof, are moved backward while sliding on the lower surface of the staple sheet SS. In the forward movements thereof, the feed pawls 218, 219 are engaged with the hollows of the staple sheet SS that are formed between staples, are allowed to move the staple sheet SS forward and supply the staple sheet SS from a staple magazine M mounted in the magazine storage portion 211 to the staple sheet storage portion 20 disposed forwardly thereof, and are also allowed to forwardly feed out the staple sheet SS from inside the staple sheet storage portion 20, thereby carrying out a paper binding processing.

Figure 21:
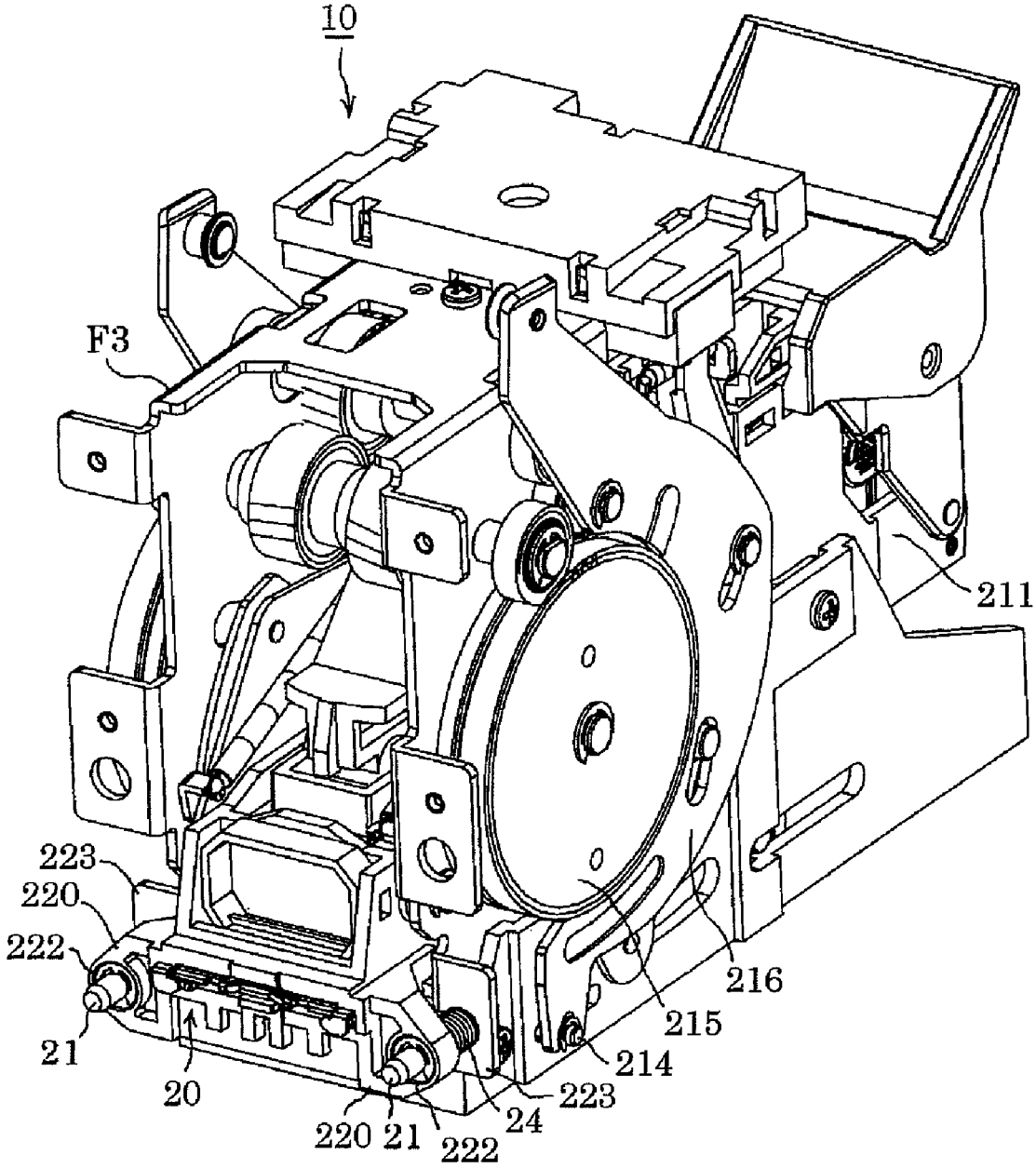
FIG. 21 is a perspective view of the staple feed assembly.

As shown in FIGS. 20B and 21, on the right and left sides of a staple exit opened up in the front surface of the staple sheet storage portion 20, there are provided flange portions 220. The positioning pins 21 are respectively inserted into positioning holes formed in the flange portions 220 and are respectively fixed by their associated snap rings 222 (E rings). The rear portions of the positioning pins 21 fixed to the flange portions 220 are respectively inserted into the positioning holes of striking plates 223 which are provided on the front surface portion of the feed device frame F3. Snap rings 224 are attached on the respective leading ends of the positioning pins 21 to prevent the associated positioning pins 21 from slipping out. Between the flange portions 220 of the staple sheet storage portion 20 and the striking plates 223 of the feed device frame F3, there are interposed compression coil springs 24. The staple sheet storage portion 20 is biased forwardly by these compression coil springs 24.

The staple sheet storage portion 20 is secured to the feed device frame F3 only by the positioning pins 21 and, between the internal space of the feed device frame F3 and stapler sheet storage portion 20, there exists a slight clearance, whereby the staple sheet storage portion 20 can be moved only slightly in the front-and-back direction, in the vertical direction, and in the right and left direction.

FIG. 7 shows a state in which the driver assembly 3 is detached from the stapler main body 11. A driver assembly lock mechanism 226, which is provided on the front portion of the frame F2 of the stapler main body 11, includes a pair of slide-type side panels 28 respectively mounted on the right and left side surfaces of the frame F2, and the hold cover 38 connected to the pair of side panels 28.

The side panels 28 are pin connected to the slots 29, 30 of the frame F2 (which are shown in part in FIGS. 7 and 12). The slots 29, 30 respectively have a forwardly inclined shape which is long in the vertical direction and the upper portion thereof is situated forwardly of the lower portion thereof. When the hold cover 38 is lifted up, the side panels 28 are also lifted up upwardly, and when the hold cover 38 is rotated downward and is thereby closed, the side panels 28 are also pulled down. In the lifted state thereof, the side panels 28 are situated at positions slightly forward of the positions thereof where they are lowered.

Each side panel 28 includes two downward pawl portions 31, 32 which are respectively formed in the upper and lower portions of the front edge thereof. Four projections 35, 36, which are respectively provided on and projected right and left from the driver assembly 3, can be engaged with the downward pawl portions 31, 32 of the two side panels 28, whereby the driver assembly 3 can be fixed to the front surface of the frame F2.

The details of the driver assembly 3 are shown in FIG. 6. The driver assembly 3 includes the front side slide guide case portion 16, slide block portion 6, driver portion 5, forming portion 4 and rear side slide guide case portion 17. The front side slide guide case portion 16 and the rear side slide guide case portion 17 cooperate together in constituting a casing, and the slide block portion 6, driver portion 5 and forming portion 4 can be moved up and down inside the casing.

To the front side slide guide case portion 16, there is assembled the face back plate 59 such that it can be oscillated back and forth. In a state where the driver assembly 3 is assembled, the face back plate 59 is situated behind the anvil 15 disposed in the center of the back surface (in FIG. 6, on this side) of the slide block portion 6 against which a staple is pressed. And, the face back plate 59 includes a projecting portion 63 which is provided in the central portion of the right and left direction thereof, while the projecting portion 63 projects slightly forwardly with a width equal to a clearance between the right and left leg portions of the U-shaped staple. The projecting portion 63 functions as a seat in the staple forming operation.

The leading staple of the staple sheet supplied from the staple sheet storage portion 20 to the interior of the driver assembly 3 is moved onto the projecting portion 63 of the face back plate 59, the right and left sides of the staple are bent down by the forming portion 4 to thereby form the staple into a U-shaped staple, the U-shaped staple is pushed into the anvil 15 disposed on the back surface side of the slide block portion 6, and, in the next operation cycle of the electric stapler, the U-shaped staple is ejected out downward by the driver portion 5.

Also, on the right and left sides of the face back plate 59 that are respectively opposed to the staple sheet storage portion 20, there are formed the positioning holes 37 that respectively correspond to the positioning pins 21 of the staple sheet storage portion 20. When attaching the driver assembly 3 onto the stapler main body 11, the positioning pins 21 respectively penetrate through their associated positioning holes 37.

When the hold cover 38 is lifted up as shown in FIG. 12 from the state shown in FIG. 7 where the driver assembly 3 is not mounted yet, the right and left side panels 28 move upwardly and slightly forwardly. And, in this state, when the driver assembly 3 is matched in position and pressed against the front surface of the stapler main body 11 and the hold cover 38 is rotated downward and returned to its initial position as shown in FIG. 13, the right and left side panels 28 are moved downward and the downward pawl portions 31, 32 of the side panels 28 are engaged with the projections 35, 36 of the driver assembly 3, whereby the driver assembly 3 is pressed against the front surface of the stapler main body 11 and is fixed thereto.

Figure 22A:
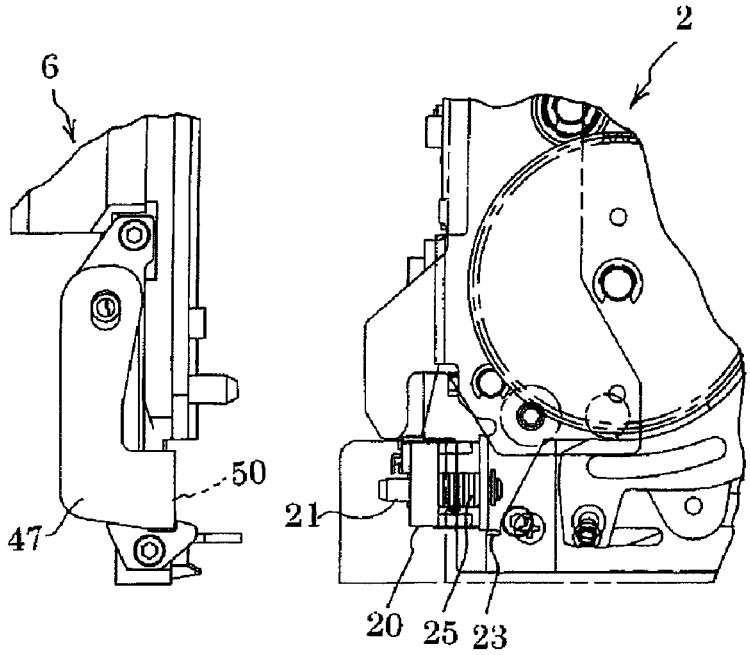
FIG. 22A is a side view, showing a state where the driver assembly is separated from the stapler main body.
Figure 22B:
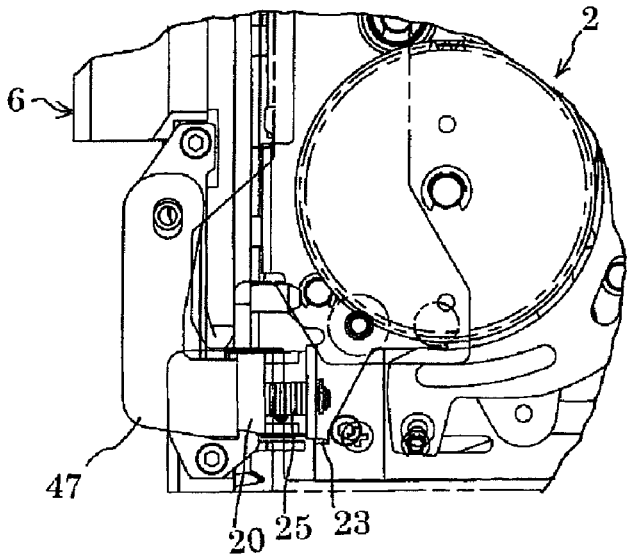
FIG. 22B is a side view, showing a state where the driver assembly is mounted on the stapler main body.

FIGS. 22A and 22B show a state where the driver assembly 3 is mounted onto the staple main body 11. When the driver assembly 3 is contacted with the front surface of the stapler main body 11 from the state shown in FIG. 22A, the positioning pins 21 of the staple sheet storage portion 20 are respectively inserted into the positioning holes 37 of the face back plate 59 of the driver assembly 3. The driver assembly 3 is pressed against the front surface of the stapler main body 11 by the above-mentioned locking operation, whereby the staple sheet storage portion 20 receives a retreat pressure and is pressure contacted with the face back plate 59 with no clearance between them due to the spring force of the compression coil spring 24.

As described above, the staple sheet storage portion 20 is slightly movable in the vertical direction and in the right and left direction as well. Thus, by the engagement between the positioning pins 21 and positioning holes 37, the vertical, right and left direction positions of the staple sheet storage portion 20 and face back plate 59 also coincide with each other accurately.

According to the above-mentioned embodiment, there is employed the structure that, separately from the magazine storage portion 211, there is disposed the staple sheet storage portion 20, a staple sheet is supplied from the magazine storage portion 211 to the staple sheet storage portion 20, and the staple sheet is supplied from the staple sheet storage portion 20 to the driver assembly 3. However, there may also be employed another structure that, the magazine storage portion 211 shown in the accompanying drawings is omitted and a staple magazine is directly loaded into the staple sheet storage portion 20.

Also, instead of the structure that the staple sheet storage portion 20 and face back plate 59 are pressure contacted with each other using the compression coil spring and are positioned using the positioning pins and positioning holes, there may also be employed another structure that the face back plate 59 is screwed to the staple sheet storage portion 20. This structure is also capable of not only canceling play but also position matching. However, when screwing the face back plate 59, it is necessary to adjust the positions of the face back plate 59 and staple sheet storage portion 20. That is, the above-mentioned embodiment of the invention is easier to match their positions to each other. Also, the elastic member is not limited to the compression coil spring but there may also be used an elastic member which can be produced by forming an elastic resin member into a ring shape or a cylindrical shape.

Although the invention has been described heretofore in detail or with reference to specific embodiments thereof, it is obvious to a person skilled in the art that various changes and modifications can be made without departing from the spirit and scope of the invention.

The present application is based on Japanese Patent Application No. 2005-291481 filed on Dec. 4, 2005, Japanese Patent Application No. 2005-291483 filed on Dec. 4, 2005, Japanese Patent Application No. 2005-306436 filed on Dec. 20, 2005, and Japanese Patent Application No. 2005-307283 filed on Dec. 21, 2005, the contents of which are incorporated herein by reference.

INDUSTRIAL APPLICABILITY

When dealing with a staple jam in a driver portion, replacing parts, maintaining parts or the like in an electric stapler, parts involved with forming and striking of a staple can be detached or attached easily and quickly, thereby saving time and labor for attaching and detaching a plurality of parts separately.

The invention claimed is:

1. An electric stapler comprising:

a stapler main body; and a driver assembly which is attachable and detachable with respect to the stapler main body, wherein the driver assembly comprises:

a forming portion comprising a forming plate for forming a staple into a U shape;

a driver portion having a driver plate for striking the U-shaped staple into papers;

a slide block portion which slidably guides the driver portion; and a slide guide case portion, wherein the slide block portion, the driver portion and the forming portion are integrally incorporated in the slide guide case portion, the driver assembly further comprises a fitting pin extending in a front-and-back direction of the stapler main body, the stapler main body comprises an openable and closable hold cover, the driver assembly is detachably attached to the stapler main body via the fitting pin, and the hold cover locks an upper portion of the driver assembly.

2. The electric stapler according to claim 1, further comprising:

an anvil serving as a bending base when forming the staple into the U shape; and a crown plate which supports a crown portion of the U-shaped staple, wherein the anvil and crown plate are disposed on the slide block portion so as to be openable and closable respectively.

3. An electric stapler comprising:

a stapler main body; and a driver assembly which is attachable and detachable with respect to the stapler main body, wherein the driver assembly comprises:

a forming portion comprising a forming plate for forming a staple into a U shape;

an anvil serving as a bending base when forming the staple into the U shape;

a crown plate which supports a crown portion of the U-shaped staple;

a driver portion having a driver plate for striking the U-shaped staple into papers;

a slide block portion which slidably guides the driver portion; and a slide guide case portion, wherein the anvil and crown plate are disposed on the slide block portion so as to be openable and closable respectively, and the slide block portion, the driver portion and the forming portion are integrally incorporated in the slide guide case portion.

4. An electric stapler comprising:

a stapler main body; and a driver assembly which is attachable and detachable with respect to the stapler main body, wherein the driver assembly comprises:

a forming portion comprising a forming plate for forming a staple into a U shape;

a driver portion having a driver plate for striking the U-shaped staple into papers;

a slide block portion which slidably guides the driver portion;

a slide block latch disposed on the slide block portion; and a slide guide case portion, wherein the driver portion has a slot extending in a striking direction of the staple, the slide block latch engages with the slot when the driver portion slides, and the slide block portion, the driver portion and the forming portion are integrally incorporated in the slide guide case portion.

5. The electric stapler according to claim 4, further comprising biasing means for downwardly biasing the slide block portion, wherein the slide guide case portion comprises a support surface, the slide block portion is slidably disposed with respect to the slide guide case portion, and a portion of the slide block latch is pressed against the support surface of the slide guide case portion when the biasing means biases the slide block portion while the slide block portion is situated at a top dead center thereof.

6. An electric stapler comprising:

a stapler main body; and a driver assembly which is attachable and detachable with respect to the stapler main body, wherein the driver assembly comprises:

a forming portion comprising a forming plate for forming a staple into a U shape;

a driver portion having a driver plate for striking the U-shaped staple into papers;

a slide block portion which slidably guides the driver portion;

a slide guide case portion; and a lock mechanism which, when detaching the driver assembly from the stapler main body, locks the forming portion, the driver portion and the slide block portion at respective regular home positions with respect to the slide guide case portion, wherein the slide block portion, the driver portion and the forming portion are integrally incorporated in the slide guide case portion.

7. The electric stapler according to claim 6, wherein the driver assembly or the stapler main body further comprises an unlock mechanism which, when attaching the driver assembly to the stapler main body, releases a locked state of the lock mechanism.

8. The electric stapler according to claim 6, wherein the forming portion, the driver portion and the slide block portion are formed with engaging grooves on one side portion thereof respectively, the lock mechanism comprises a lock pin which is engageable and disengageable with respect to the engaging grooves, and when the lock pin is engaged with the engaging grooves, the forming portion, the driver portion and the slide block portion are locked at the respective regular home positions with respect to the slide guide case portion.

9. The electric stapler according to claim 8, wherein each the engaging grooves is formed such that a groove depth thereof is increased in accordance with a dimension of a width of each of the forming portion, the driver portion and the slide block portion.

10. An electric stapler comprising:

a stapler main body; and a driver assembly which is attachable and detachable with respect to the stapler main body, wherein the stapler main body comprises:

a driver drive device;

a staple feed assembly;

a frame inside which the driver drive device and the staple feed assembly are accommodated; and an elastic member, wherein the staple feed assembly comprises a staple storage portion disposed so as to be back-and-forth movable with respect to the frame, and the elastic member forwardly biases the staple storage portion to cause the staple storage portion to be in pressure contact with the driver assembly which is attached on a front surface of the frame, and wherein the driver assembly comprises:

a forming portion comprising a forming plate for forming a staple into a U shape;

a driver portion having a driver plate for striking the U-shaped staple into papers;

a slide block portion which slidably guides the driver portion; and a slide guide case portion, wherein the slide block portion, the driver portion and the forming portion are integrally incorporated in the slide guide case portion.

11. An electric stapler comprising:

a stapler main body; and a driver assembly which is attachable and detachable with respect to the stapler main body, wherein the stapler main body comprises:

a driver drive device;

a staple feed assembly; and a frame inside which the driver drive device and the staple feed assembly are accommodated, wherein the staple feed assembly comprises a staple storage portion disposed so as to be slightly movable in an up-and-down direction and in a right-and-left direction with respect to the frame, and a pin is provided on one of mutually opposing surfaces of the driver assembly and staple storage portion while a positioning hole is provided on the other surface, and the pin is fitted into the positioning hole, and wherein the driver assembly comprises:

a forming portion comprising a forming plate for forming a staple into a U shape;

a driver portion having a driver plate for striking the U-shaped staple into papers;

a slide block portion which slidably guides the driver portion; and a slide guide case portion, wherein the slide block portion, the driver portion and the forming portion are integrally incorporated in the slide guide case portion.

* * * * *